US011715419B2

(12) United States Patent
Park et al.

(10) Patent No.: US 11,715,419 B2
(45) Date of Patent: Aug. 1, 2023

(54) DISPLAY DEVICE

(71) Applicant: Samsung Display Co., Ltd., Yongin-Si (KR)

(72) Inventors: Sehyuk Park, Seongnam-si (KR); Hongsoo Kim, Hwaseong-si (KR); Jinyoung Roh, Hwaseong-si (KR); Hyojin Lee, Seongnam-si (KR); Jaekeun Lim, Suwon-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/244,095

(22) Filed: Apr. 29, 2021

(65) Prior Publication Data

US 2022/0028334 A1 Jan. 27, 2022

(30) Foreign Application Priority Data

Jul. 24, 2020 (KR) ..... 10-2020-0092317

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3266* (2013.01); *G09G 3/3283* (2013.01);
(Continued)

(58) Field of Classification Search
CPC .. G09G 3/3233; G09G 3/3283; G09G 3/3266; G09G 3/3677; G09G 2310/08; G09G 2320/0626; G09G 2330/021
(Continued)

(56) References Cited

U.S. PATENT DOCUMENTS 9,024,979 B2 5/2015 Lee et al.
9,633,608 B2 4/2017 Shin
(Continued)

FOREIGN PATENT DOCUMENTS

KR 101192583 B1 10/2012
KR 1020150069850 A 6/2015
(Continued)

OTHER PUBLICATIONS

English Translation for WO 2020/194492 A1, pp. 1-19, 2022 (Year: 2022).*

*Primary Examiner* — Jimmy H Nguyen
(74) *Attorney, Agent, or Firm* — Cantor Colburn LLP

(57) ABSTRACT

A display device includes a display panel which defines first and second display areas, and includes pixels connected to data lines and scan lines, respectively, a data driving circuit which drives the data lines, a scan driving circuit which drives the scan lines, and a driving controller which receives an image signal and a control signal, control the data and scan driving circuits according to an operation mode, and output clock signals. In a multi-frequency mode, the scan driving circuit includes a first scan driving circuit corresponding to the first display area and a second scan driving circuit corresponding to the second display area. The second scan driving circuit sequentially drives first scan lines among scan lines corresponding to the second display area during a first frame, and sequentially drives second scan lines among scan lines corresponding to the second display area during a second frame.

19 Claims, 16 Drawing Sheets

(51) Int. Cl.
*G09G 3/3283* (2016.01)
*G09G 3/36* (2006.01)

(52) U.S. Cl.
CPC ..... *G09G 3/3677* (2013.01); *G09G 2310/08* (2013.01); *G09G 2320/0626* (2013.01); *G09G 2330/021* (2013.01)

(58) Field of Classification Search
USPC ..... 345/214, 76, 98–100
See application file for complete search history.

(56) References Cited

U.S. PATENT DOCUMENTS

| | | | | |
|---|---|---|---|---|
| 2011/0227961 | A1* | 9/2011 | Kikuta | G09G 3/007 345/690 |
| 2016/0329014 | A1* | 11/2016 | Lee | G09G 3/2096 |
| 2018/0197482 | A1* | 7/2018 | Choi | G09G 3/3266 |

FOREIGN PATENT DOCUMENTS

| | | | | |
|---|---|---|---|---|
| KR | 1020160081424 | A | 7/2016 | |
| KR | 1020170020107 | A | 2/2017 | |
| KR | 1020180018898 | A | 2/2018 | |
| KR | 101868851 | B1 | 6/2018 | |
| WO | WO-2020194492 | A1 * | 10/2020 | G09G 3/20 |

* cited by examiner

DISPLAY DEVICE

This application claims priority to Korean Patent Application No. 10-2020-0092317, filed on Jul. 24, 2020, and all the benefits accruing therefrom under 35 U.S.C. § 119, the content of which in its entirety herein incorporated by reference.

BACKGROUND

1. Field

The present disclosure herein relates to a display device, and more particularly, to a display device capable of multi-frequency driving.

2. Description of the Related Art

Among display devices, an organic light-emitting display device displays an image using an organic light emitting diode that generates light by recombination of electrons and holes. Such an organic light emitting diode display has an advantage of having a fast response speed and being driven with low power consumption.

The organic light emitting display device includes pixels connected to data lines and scan lines. The pixels generally include an organic light emitting diode and a circuit unit for controlling an amount of current flowing through the organic light emitting diode. The circuit unit controls the amount of current flowing from a first driving voltage to a second driving voltage through an organic light emitting diode in response to a data signal. In this case, light having a predetermined luminance is generated in response to the amount of current flowing through the organic light emitting diode.

As the field of use of the display device is diversified, a plurality of different images may be displayed on a single display device. There is a need for a technology to reduce power consumption of a display device displaying a plurality of images.

SUMMARY

The disclosure provides a display device capable of reducing power consumption.

An embodiment of the inventive concept provides a display device including: a display panel which defines a first display area and a second display area, and includes a plurality of pixels connected to a plurality of data lines and a plurality of scan lines, respectively; a data driving circuit which drives the plurality of data lines; a scan driving circuit which drives the plurality of scan lines; and a driving controller which receives an image signal and a control signal, control the data driving circuit and the scan driving circuit according to an operation mode, and output a plurality of clock signals. The scan driving circuit includes a first scan driving circuit corresponding to the first display area and a second scan driving circuit corresponding to the second display area, and in a multi-frequency mode the second scan driving circuit sequentially drives first scan lines among scan lines corresponding to the second display area during a first frame, and sequentially drives second scan lines among scan lines corresponding to the second display area during a second frame consecutive with the first frame.

In an embodiment, the first scan lines and the second scan lines may extend in a first direction and may be alternately arranged in a second direction intersecting the first direction.

In an embodiment, the second scan driving circuit sequentially may drive the first scan lines and the second scan lines in the order of being arranged in the second direction during a normal frequency mode.

In an embodiment, the first frame of the multi-frequency mode may include a first driving period and a second driving period, the second frame consecutive with the first frame in the multi-frequency mode may include a third driving period and a fourth driving period, the plurality of clock signals includes first to fourth clock signals, and the driving controller may output the first to fourth clock signals having different phases, output the second and fourth clock signals of an inactive level during the second driving period, and output the first and third clock signals of an inactive level during the fourth driving period.

In an embodiment, the second scan driving circuit may include: first driving stages each which outputs a first scan signal to a corresponding first scan line among the first scan lines in response to the first and third clock signals and a carry signal; and second driving stages each which outputs a second scan signal to a corresponding second scan line among the second scan lines in response to the second and fourth clock signals and a carry signal.

In an embodiment, the first scan signal outputted from a j-th (j is a natural number) first driving stage among the first driving stages may be provided as the carry signal of a (j+1)-th first driving stage among the first driving stages, and the second scan signal outputted from a j-th (j is a natural number) second driving stage among the second driving stages may be provided as the carry signal of a (j+1)-th second driving stage among the second driving stages.

In an embodiment, one of the first driving stages and one of the second driving stages may receive a scan signal outputted from the first scan driving circuit as the carry signal.

In an embodiment, the first scan driving circuit may include driving stages each which outputs a scan signal to a scan line corresponding to the first display area among the scan lines in response to corresponding clock signals among the plurality of clock signals and a carry signal.

In an embodiment, the driving controller may provide a start signal to the first scan driving circuit, and a first driving stage of the driving stages of the first scan driving circuit may receive the start signal as the carry signal.

In an embodiment, the second scan driving circuit may include driving stages each which outputs a scan signal to a corresponding scan line of the first and second scan lines in response to corresponding clock signals among the plurality of clock signals and a carry signal.

In an embodiment, one of the driving stages of the second scan driving circuit may receive the scan signal outputted from the first scan driving circuit as the carry signal.

In an embodiment, the scan signal outputted from a j-th (j is a natural number) driving stage among the driving stages of the second scan driving circuit may be provided as the carry signal of a (j+1)-th driving stage.

In an embodiment, the second display area of the display panel may include: first pixels connected to the first scan lines; and second pixels connected to the second scan lines.

In an embodiment, the first pixels and the second pixels may be alternately arranged in a first direction, where the first pixels and the second pixels may be alternately arranged in a second direction intersecting the first direction.

In an embodiment, the first scan lines and the second scan lines may be alternately arranged in the second direction.

In an embodiment of the inventive concept, a display device includes: a display panel which defines a first non-folding area, a folding area, and a second non-folding area, and includes a plurality of pixels connected to a plurality of data lines and a plurality of scan lines, respectively; a data driving circuit which drives the plurality of data lines; a scan driving circuit which drives the plurality of scan lines; and a driving controller which receives an image signal and a control signal, control the data driving circuit and the scan driving circuit according to an operation mode, and output a plurality of clock signals. The display panel is divided into a first display area and a second display area, the scan driving circuit includes a first scan driving circuit corresponding to the first display area and a second scan driving circuit corresponding to the second display area, and in a multi-frequency mode the second scan driving circuit sequentially drives first scan lines among scan lines corresponding to the second display area during a first frame, and sequentially drives second scan lines among scan lines corresponding to the second display area during a second frame consecutive with the first frame.

In an embodiment, the first scan lines and the second scan lines may extend in a first direction and are alternately arranged in a second direction intersecting the first direction.

In an embodiment, the first frame of the multi-frequency mode may include a first driving period and a second driving period, the second frame consecutive with the first frame in the multi-frequency mode may include a third driving period and a fourth driving period, the plurality of clock signals includes first to fourth clock signals, and the driving controller may output the first to fourth clock signals having different phases, output the second and fourth clock signals of an inactive level during the second driving period, and output the first and third clock signals of an inactive level during the fourth driving period.

In an embodiment, the second scan driving circuit may include: first driving stages each which outputs a first scan signal to a corresponding first scan line among the first scan lines in response to the first and third clock signals and a carry signal; and second driving stages each which outputs a second scan signal to a corresponding second scan line among the second scan lines in response to the second and fourth clock signals and a carry signal.

In an embodiment, the second display area of the display panel may include: first pixels connected to the first scan lines; and second pixels connected to the second scan lines, where the first pixels and the second pixels are alternately arranged in a first direction, where the first pixels and the second pixels are alternately arranged in a second direction intersecting the first direction.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
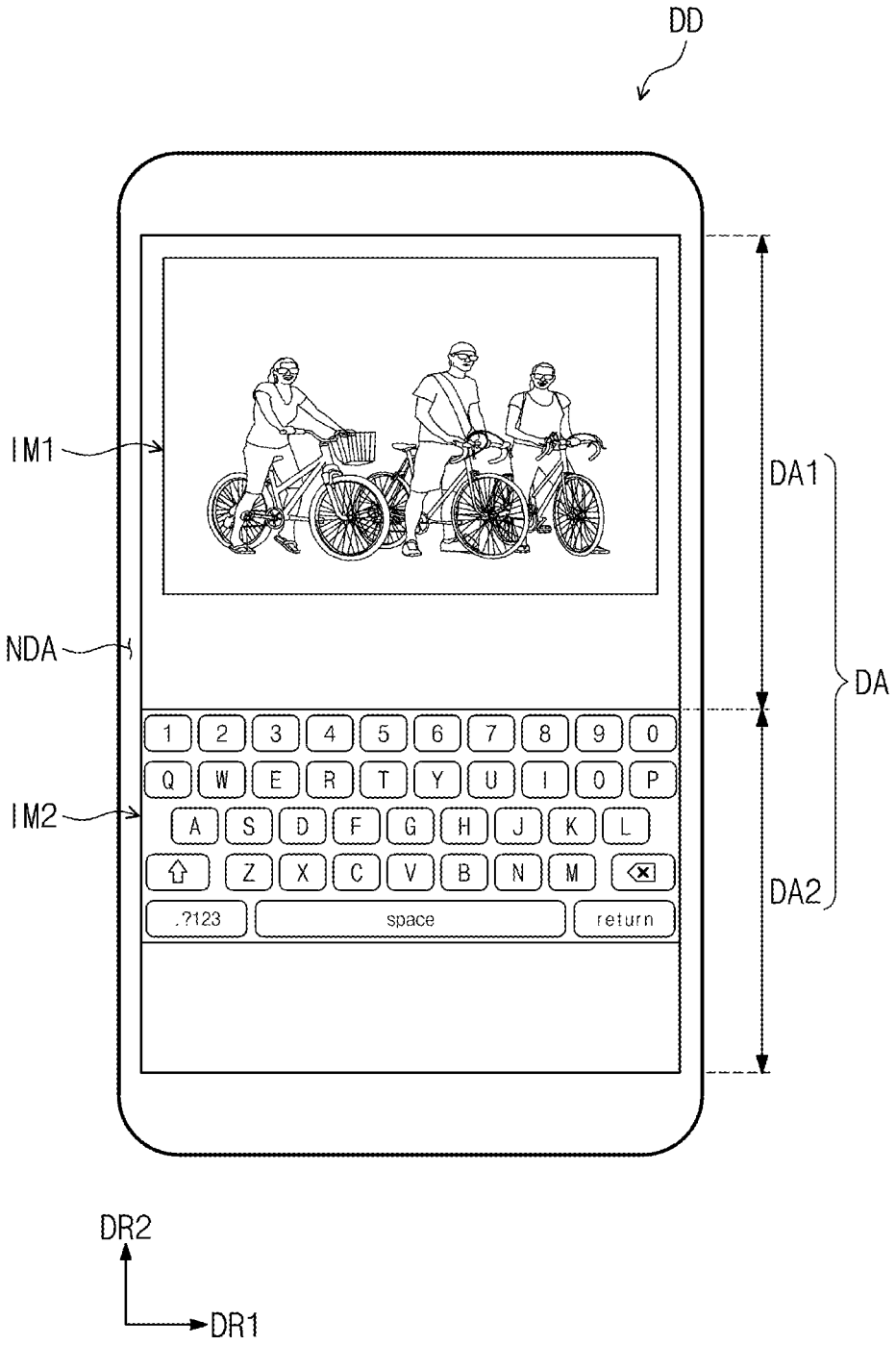
FIG. 1 is a plan view of a display device according to an embodiment of the inventive concept.

In this specification, when an element (or region, layer, part, etc.) is referred to as being "on", "connected to", or "coupled to" another element, it means that it can be directly placed on/connected to/coupled to other components, or a third component can be arranged between them.

Like reference numerals refer to like elements. Additionally, in the drawings, the thicknesses, proportions, and dimensions of components are exaggerated for effective description. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." "And/or" includes all of one or more combinations defined by related components.

It will be understood that the terms "first" and "second" are used herein to describe various components but these components should not be limited by these terms. The above terms are used only to distinguish one component from another. For example, a first component may be referred to as a second component and vice versa without departing from the scope of the inventive concept. The terms of a singular form may include plural forms unless otherwise specified.

In addition, terms such as "below", "the lower side", "on", and "the upper side" are used to describe a relationship of configurations shown in the drawing. The terms are described as a relative concept based on a direction shown in the drawing.

In various embodiments of the inventive concept, the term "include," "comprise," "including," or "comprising," specifies a property, a region, a fixed number, a step, a process, an element and/or a component but does not exclude other properties, regions, fixed numbers, steps, processes, elements and/or components.

Unless otherwise defined, all terms (including technical and scientific terms) used herein have the same meaning as commonly understood by one of ordinary skill in the art to which this inventive concept belongs. In addition, terms defined in a commonly used dictionary should be interpreted as having a meaning consistent with the meaning in the context of the related technology, and unless interpreted in an ideal or overly formal sense, the terms are explicitly defined herein.

Hereinafter, embodiments of the inventive concept will be described with reference to the drawings.

FIG. 1 is a plan view of a display device according to an embodiment of the inventive concept.

Referring to FIG. 1, a portable terminal is illustrated as an example of a display device DD according to an embodiment of the inventive concept. The portable terminal may include a tablet PC, a smart phone, a personal digital assistant ("PDA"), a portable multimedia player ("PMP"), a game console, and a wrist watch type electronic device. However, the inventive concept is not limited thereto. The inventive concept can be used in large electronic equipment such as televisions or external billboards, as well as small and medium-sized electronic equipment such as personal computers, notebook computers, kiosks, car navigation units, and cameras. These are only presented by way of example, and can be employed in other electronic devices without departing from the concept of the inventive concept.

As shown in FIG. 1, the display surface on which the first image IM1 and the second image IM2 are displayed is parallel to a plane defined by the first direction DR1 and the second direction DR2. The display device DD includes a plurality of areas divided on the display surface. The display surface includes a display area DA in which the first and second images IM1 and IM2 are displayed, and a non-display area NDA adjacent to the display area DA. The non-display area NDA may be referred to as a bezel area. For example, the display area DA may have a rectangular shape. The non-display area NDA surrounds the display area DA. Further, although not shown in the drawing, for example, the display device DD may have a partially curved shape. As a result, one area of the display area DA may have a curved shape.

The display area DA of the display device DD includes a first display area DA1 and a second display area DA2. In a specific application program, the first image IM1 may be displayed in the first display area DA1, and the second image IM2 may be displayed in the second display area DA2. For example, the first image IM1 may be a moving image, and the second image IM2 may be a still image or text information which does not change for a relatively long period compared to the moving image.

The display device DD according to an embodiment may drive the first display area DA1 in which a moving image is displayed at a normal frequency, and drive the second display area DA2 in which a still image is displayed at a lower frequency than the normal frequency. The display device DD may reduce power consumption by lowering the driving frequency of the second display area DA2.

The first and second display areas DA1 and DA2 may have preset sizes, respectively, and the sizes may be changed by an application program. In an embodiment, when the first display area DA1 displays a still image and the second display area DA2 displays a moving image, the first display area DA1 may be driven at the low frequency, and the second display area DA2 may be driven at the normal frequency. In another embodiment, the display area DA may be divided into three or more display areas, and the driving frequency of each of the divided display areas may be determined according to the type of image (e.g., still image or moving image) displayed on each of the divided display areas.

Figure 2A:
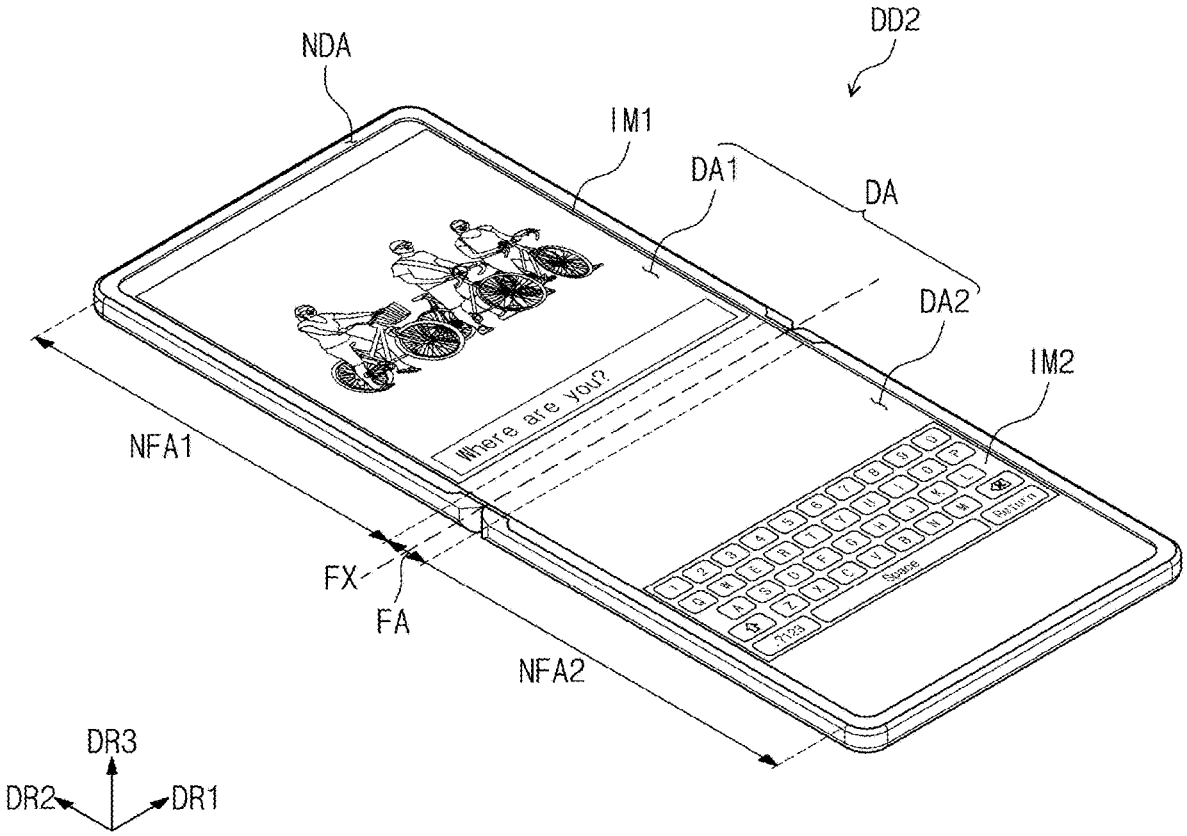
FIGS. 2A and 2B are perspective views of a display device according to an embodiment of the inventive concept.
Figure 2B:
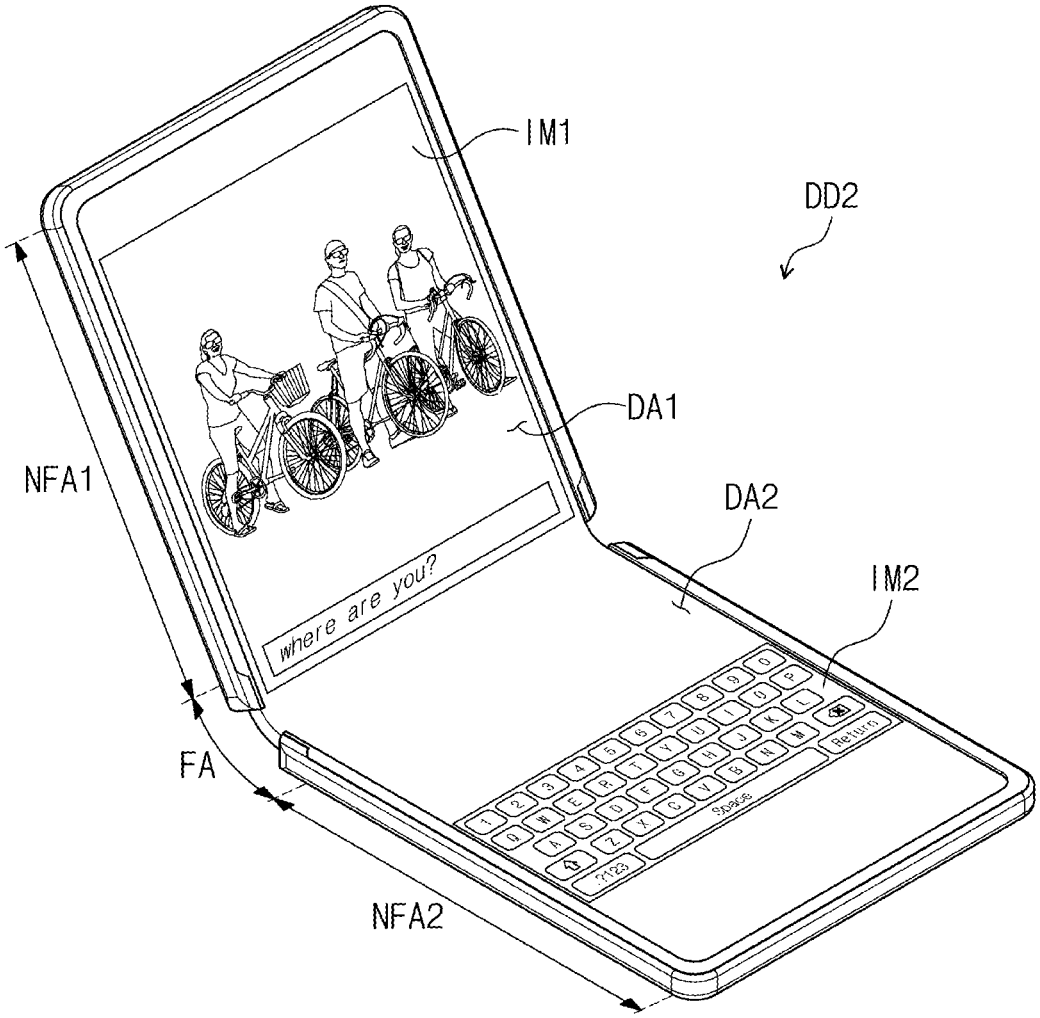

FIGS. 2A and 2B are perspective views of a display device according to an embodiment of the inventive concept. FIG. 2A illustrates a state in which the display device DD2 is unfolded, and FIG. 2B illustrates a state in which the display device DD2 is intermediately folded.

As shown in FIGS. 2A and 2B, the display device DD2 includes a display area DA and a non-display area NDA. The display device DD2 may display an image through the display area DA. When the display device DD2 is unfolded, the display area DA may include a plane defined by the first direction DR1 and the second direction DR2. The thickness direction of the display device DD2 may be parallel to the third direction DR3 intersecting the first direction DR1 and the second direction DR2. Accordingly, the front (in other words, upper) and rear (in other words, lower) surfaces of the members constituting the display device DD2 may be defined with respect to the third direction DR3. The non-display area NDA may be referred to as a bezel area. For example, the display area DA may have a rectangular shape. The non-display area NDA surrounds the display area DA.

The display area DA may include a first non-folding area NFA1, a folding area FA, and a second non-folding area NFA2. The folding area FA may be bendable with respect to the folding axis FX extending along the first direction DR1.

When the display device DD2 is completely folded, the first non-folding area NFA1 and the second non-folding area NFA2 may face each other. Accordingly, in the fully folded state, the display area DA may not be exposed to the outside, and this folding type may be referred to as "in-folding". However, this is exemplary, and the operation of the display device DD2 according to the invention is not limited thereto.

For example, in another embodiment of the inventive concept, when the display device DD2 is completely folded, the first non-folding area NFA1 and the second non-folding area NFA2 may be opposed to each other. Accordingly, in the folded state, the first non-folding area NFA1 may be exposed to the outside, and this folding type may be referred to as "out-folding".

The display device DD2 may perform only one operation of in-folding or out-folding. Alternatively, the display device DD2 may perform both an in-folding operation and an out-folding operation. In this case, the same area of the display device DD2, for example, the folding area FA, may be in-folded and out-folded. Alternatively, some areas of the display device DD2 may be in-folded and other areas may be out-folded.

In FIGS. 2A and 2B, for example, one folding area and two non-folding areas are illustrated, but the number of folding areas and non-folding areas according to the invention is not limited thereto. For example, the display device DD2 may include more than two non-folding areas and a plurality of folding areas disposed between adjacent non-folding areas.

FIGS. 2A and 2B exemplarily show that the folding axis FX is parallel to the short axis (i.e., latitudinal axis) of the display device DD2 but the inventive concept is not limited thereto. In another embodiment, for example, the folding axis FX may extend along a long axis (i.e., longitudinal axis) of the display device DD2, for example, a direction parallel to the second direction DR2. In this case, the first non-folding area NFA1, the folding area FA, and the second non-folding area NFA2 may be sequentially arranged along the second direction DR2.

A plurality of display areas DA1 and DA2 may be defined in the display area DA of the display device DD2. In FIG. 2A, two display areas DA1 and DA2 are illustrated by way of example, but the number of the plurality of display areas according to the invention is not limited thereto.

The plurality of display areas DA1 and DA2 may include a first display area DA1 and a second display area DA2. For example, the first display area DA1 may be an area in which the first image IM1 is displayed, and the second display area DA2 may be an area in which the second image IM2 is displayed, but the inventive concept is not limited thereto. For example, the first image IM1 may be a moving image, and the second image IM2 may be a still image or an image which does not change for a relatively long period compared to the moving image (text information, and the like).

The display device DD2 according to an embodiment may operate differently according to an operation mode. The operation mode may include a normal frequency mode and a multi-frequency mode. The display device DD2 may drive both the first display area DA1 and the second display area DA2 at the normal frequency during the normal frequency mode. In the display device DD2 according to an embodiment, during the multi-frequency mode, the first display area DA1 in which the first image IM1 is displayed is driven at a first driving frequency, and the second display area DA2 in which the second image IM2 is displayed may be driven at a second driving frequency lower than the normal frequency. In one embodiment, the first driving frequency may be the same as the normal frequency.

The sizes of the first and second display areas DA1 and DA2 may be preset, and may be changed by an application program. In an embodiment, the first display area DA1 may correspond to the first non-folding area NFA1, and the second display area DA2 may correspond to the second non-folding area NFA2. In addition, the first portion of the folding area FA may correspond to the first display area DA1, and the second portion of the folding area FA may correspond to the second display area DA2.

In another embodiment, all of the folding area FA may correspond to only one of the first display area DA1 and the second display area DA2.

In still another embodiment, the first display area DA1 may correspond to a first portion of the first non-folding area NFA1, and the second display area DA2 may correspond to a second portion of the first non-folding area NFA1, the folding area FA, and the second non-folding area NFA2. That is, the area of the first display area DA1 may be smaller than the area of the second display area DA2.

In yet another embodiment, the first display area DA1 corresponds to the first non-folding area NFA1, the folding area FA, and a first portion of the second non-folding area NFA2, and the second display area DA2 may correspond to a second portion of the second non-folding area NFA2. That is, the area of the second display area DA2 may be smaller than the area of the first display area DA1.

As shown in FIG. 2B, in a folded state of the folding area FA, the first display area DA1 may correspond to the first non-folding area NFA1, and the second display area DA2 may correspond to the folding area FA and the second non-folding area NFA2.

Even though FIGS. 2A and 2B illustrate a display device DD2 having one folding area FA as an example of a display device, the inventive concept is not limited thereto. In another embodiment, for example, the inventive concept may be applied to a display device having two or more folding areas, a multi-surface display device having two or more display surfaces, a rollable display device, a slider display device, or the like.

In the following description, the display device DD illustrated in FIG. 1 is described as an example, but may be equally applied to the display device DD2 illustrated in FIGS. 2A and 2B.

Figure 3:
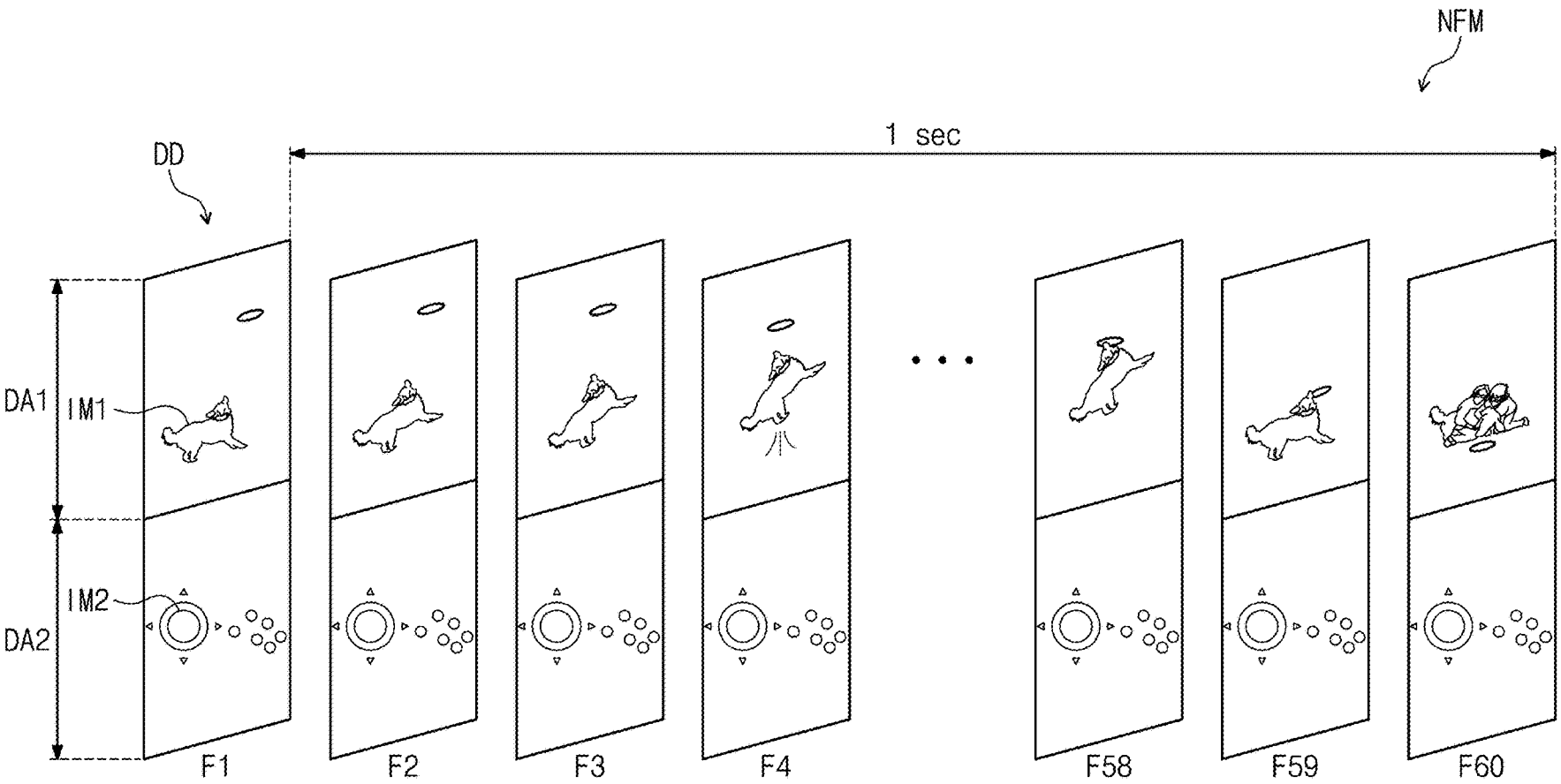
FIG. 3 is a diagram illustrating an operation of a display device in a normal frequency mode.

FIG. 3 is a diagram illustrating an operation of a display device in a normal frequency mode.

Referring to FIG. 3, the first image IM1 displayed on the first display area DA1 is a moving image, and the second image IM2 displayed on the second display area DA2 may be a still image or an image which does not change for a relatively long period compared to the moving image (e.g., UI for a keypad for game manipulation). The first image IM1 displayed in the first display area DA1 and the second image IM2 displayed in the second display area DA2 shown in FIG. 3 are only examples, and various images may be displayed on the display device DD.

In the normal frequency mode NFM, driving frequencies of the first display area DA1 and the second display area DA2 of the display device DD are normal frequencies. For example, the normal frequency may be 60 Hertz (Hz). In the normal frequency mode NFM, images of the first frame F1 to the 60th frame F60 are displayed for 1 second (sec) in the first display area DA1 and the second display area DA2 of the display device DD.

Although not shown in the drawing, in a multi-frequency mode, the display device DD may set the driving frequency of the first display area DA1 in which the first image IM1, that is, a moving image, is displayed as the first driving frequency, and may set the driving frequency of the second display area DA2 in which the second image IM2, that is, a still image, is displayed as a second driving frequency lower than the first driving frequency. In an embodiment, when the normal frequency is 60 Hz, the first driving frequency may be 60 Hz, and the second driving frequency may be 30 Hz.

In the multi-frequency mode, when the first driving frequency is 60 Hz and the second driving frequency is 30 Hz, the first image IM1 is displayed in the first frame F1 to the 60th frame F60 on the first display area DA1 of the display device DD for 1 second. Pixels corresponding to the first scan lines GLk+1, GLk+3, GLk+5, . . . , GLn (see FIG. 7) of the second display area DA2 may display the second image IM2 only in odd-numbered frames F1, F3, F5, . . . , F59. In addition, pixels corresponding to the second scan lines GLk+2, GLk+4, GLk+6, . . . , GLn+1 (see FIG. 7) of the second display area DA2 may display the second image IM2 only in even-numbered frames F2, F4, F6, . . . , F60. The operation of the display device DD in the multi-frequency mode will be described in detail later.

Figure 4:
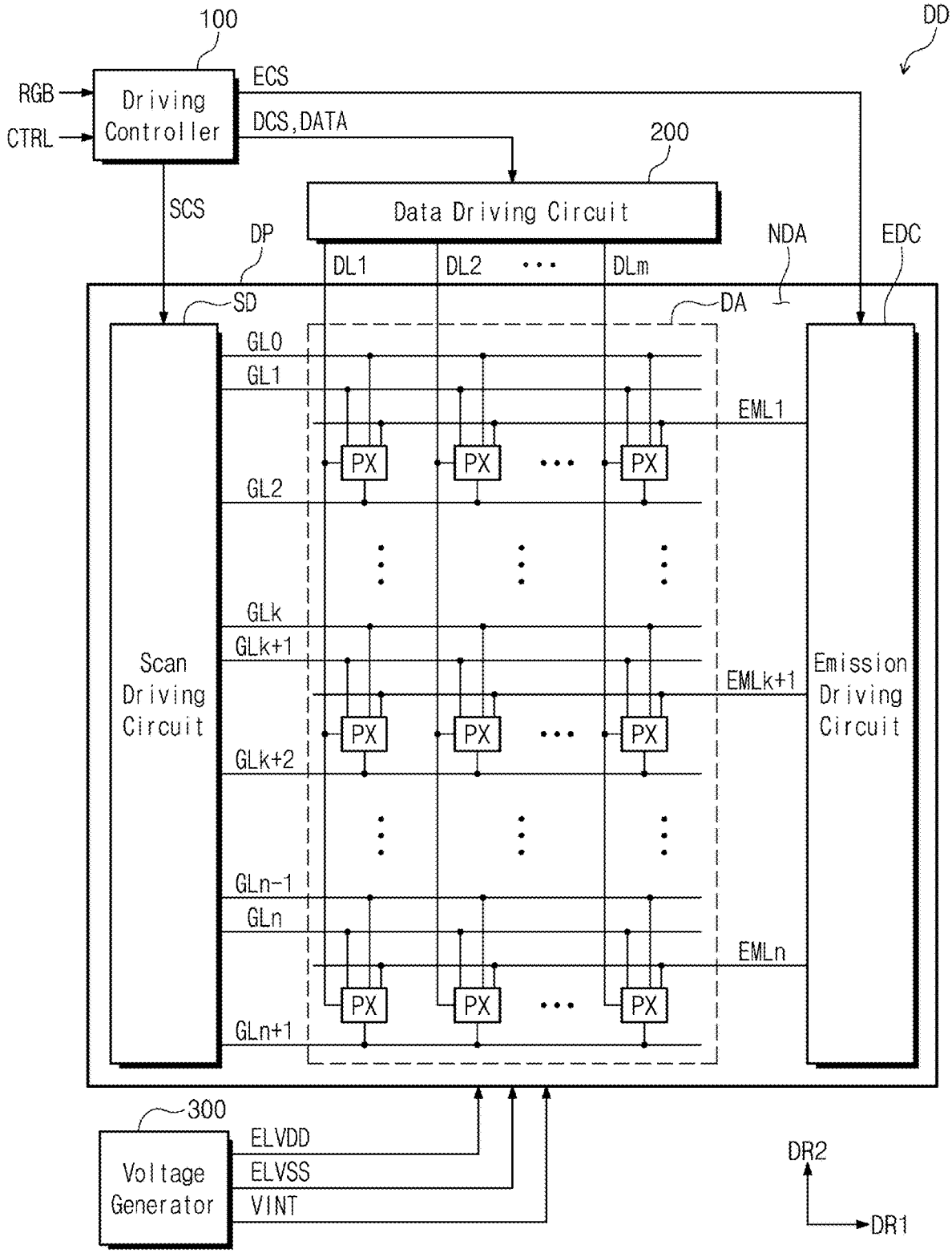
FIG. 4 is a block diagram of a display device according to an embodiment of the inventive concept.

FIG. 4 is a block diagram of a display device according to an embodiment of the inventive concept.

Referring to FIG. 4, a display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting a data format of the image signal RGB to meet the specification of an interface with the data driving circuit 200. The driving controller 100 outputs a scan control signal SCS, a data control signal DCS, and an emission control signal ECS.

The data driving circuit 200 receives a data control signal DCS and an image data signal DATA from the driving controller 100. The data driving circuit 200 converts the image data signal DATA into data signals, and outputs the data signals to a plurality of data lines DL1 to DLm, which will be described later. The data signals are analog voltages corresponding to gradation values of the image data signal DATA.

The display panel DP includes scan lines GL0 to GLn+1, emission control lines EML1 to EMLn, data lines DL1 to DLm, and pixels PX. Here, m and n are positive integers. The display panel DP may further include a scan driving circuit SD and an emission driving circuit EDC. In an embodiment, the scan driving circuit SD is arranged on the first side of the display panel DP. The scan lines GL0 to GLn+1 extend in the first direction DR1 from the scan driving circuit SD.

The emission driving circuit EDC is arranged on the second side of the display panel DP. The second side is opposite the first side with respect to the display panel DP. The emission control lines EML1 to EMLn extend in a direction opposite to the first direction DR1 from the emission driving circuit EDC.

The scan lines GL0 to GLn+1 and the emission control lines EML1 to EMLn are arranged to be spaced apart from each other in the second direction DR2. The data lines DL1 to DLm extend in a direction opposite to the second direction DR2 from the data driving circuit 200 and are arranged to be spaced apart from each other in the first direction DR1.

In the example shown in FIG. 4, the scan driving circuit SD and the emission driving circuit EDC are arranged facing each other with pixels PX interposed therebetween, but the inventive concept is not limited thereto. In another embodiment, for example, the scan driving circuit SD and the emission driving circuit EDC may be disposed adjacent to each other on one of the first side and the second side of the display panel DP. In an exemplary embodiment, the scan driving circuit SD and the emission driving circuit EDC may be configured as one circuit.

The plurality of pixels PX is electrically connected to the scan lines GL0 to GLn+1, the emission control lines EML1 to EMLn, and the data lines DL1 to DLm, respectively. Each of the plurality of pixels PX may be electrically connected to three scan lines and one emission control line. For example, as illustrated in FIG. 4, the pixels PX in the first row may be connected to the scan lines GL0, GL1, and GL2 and the emission control line EML1. Also, the pixels PX in the second row may be connected to the scan lines GL1, GL2, and GL3 and the emission control line EML2.

Each of the plurality of pixels PX includes a light emitting diode ED (see FIG. 5) and a pixel circuit unit PXC (see FIG. 5) that controls light emission of the light emitting diode ED. The pixel circuit unit PXC may include at least one transistor and at least one capacitor. The scan driving circuit SD and the emission driving circuit EDC may include transistors formed through the same process as the pixel circuit unit PXC.

Each of the pixels PX receives a first driving voltage ELVDD, a second driving voltage ELVSS, and an initialization voltage VINT.

The scan driving circuit SD receives the scan control signal SCS from the driving controller 100. The scan driving circuit SD may output scan signals to the scan lines GL0 to GLn+1 in response to the scan control signal SCS. The circuit configuration and operation of the scan driving circuit SD will be described in detail later.

The driving controller 100 according to an embodiment divides the display panel DP into a first display area DA1 (see FIG. 1) and a second display area DA2 (see FIG. 1) based on an image signal RGB and may set driving frequencies of the first display area DA1 and the second display area DA2. For example, the driving controller 100 drives the first display area DA1 and the second display area DA2 at a normal frequency (e.g., 60 Hz) in the normal frequency mode. The driving controller 100 may drive the first display area DA1 at a first driving frequency (e.g., 60 Hz) and the second display area DA2 at a low frequency (e.g., 30 Hz) in a multi-frequency mode.

Figure 5:
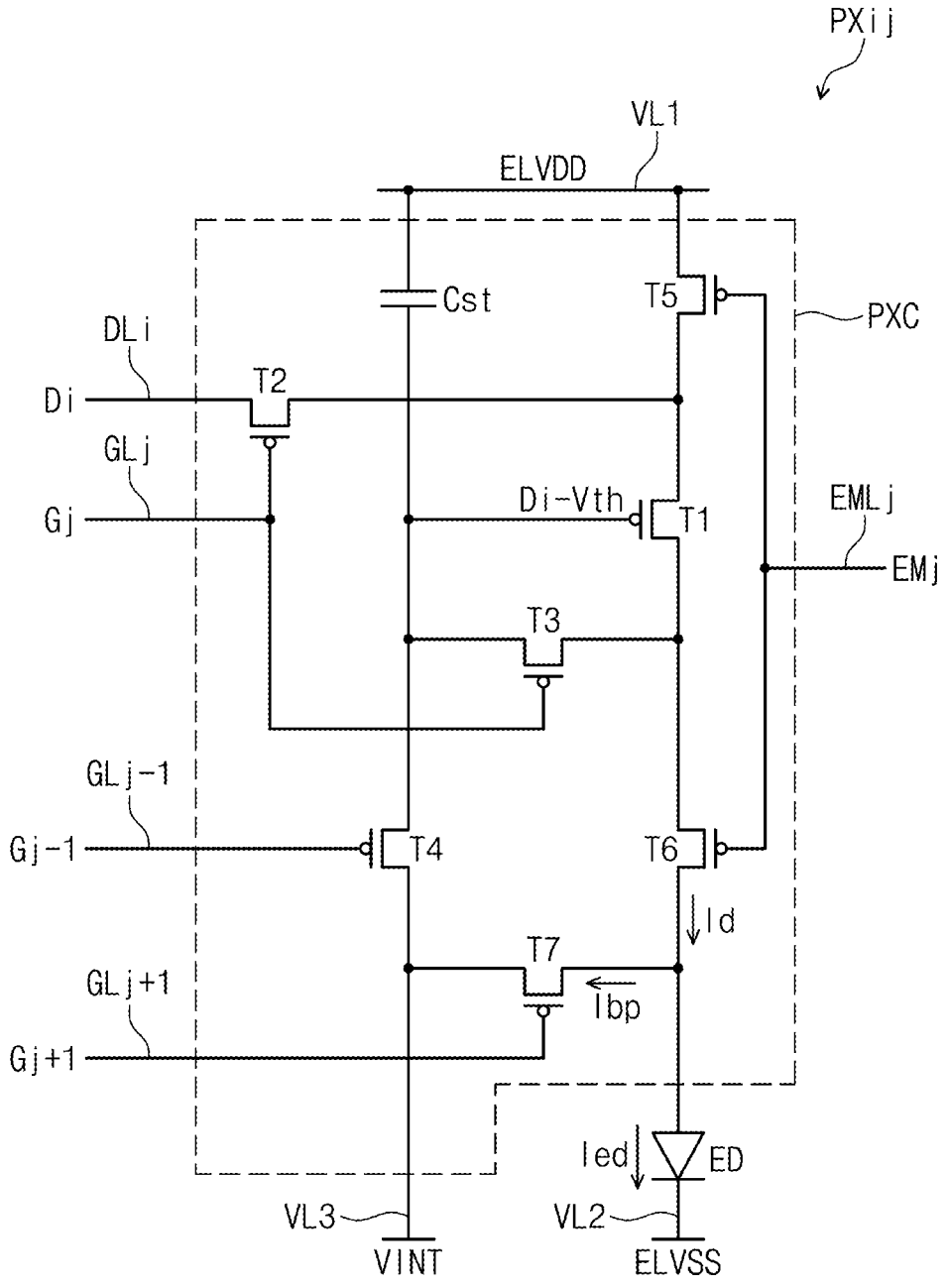
FIG. 5 is an equivalent circuit diagram of a pixel according to an embodiment of the inventive concept.

FIG. 5 is an equivalent circuit diagram of a pixel according to an embodiment of the inventive concept.

FIG. 5 shows an equivalent circuit diagram of a pixel PXij connected to the i-th data line DLi among the data lines DL1 to DLm, the (j−1)-th scan line GLj−1, the j-th scan line GLj, and the (j+1)-th scan line GLj+1 among the scan lines GL0 to GLn+1, and the j-th emission control line EMLj among the emission control lines EML1 to EMLn shown in FIG. 4. Here, i is a natural number equal to or less than m, and j is a natural number equal to or less than n.

Each of the plurality of pixels PX illustrated in FIG. 4 may have the same circuit configuration as the equivalent circuit diagram of the pixel PXij illustrated in FIG. 5. In this embodiment, the pixel circuit unit PXC of the pixel PXij includes first to seventh transistors T1 to T7 and one capacitor Cst. In addition, each of the first to seventh transistors T1 to T7 may be a P-type transistor having a low-temperature polycrystalline silicon ("LTPS") semiconductor layer. However, the inventive concept is not limited thereto, and the first to seventh transistors T1 to T7 may be N-type transistors using an oxide semiconductor as a semiconductor layer in another embodiment. In an embodiment, at least one of the first to seventh transistors T1 to T7 may be an N-type transistor and the rest may be a P-type transistor. Further, the circuit configuration of the pixel according to the inventive concept is not limited to FIG. 5. The pixel circuit unit PXC illustrated in FIG. 5 is only an example, and the configuration of the pixel circuit unit PXC may be modified and implemented.

Referring to FIG. 5, a pixel PXij of the display device DD according to an embodiment includes first to seventh transistors T1, T2, T3, T4, T5, T6, and T7, a capacitor Cst, and at least one light emitting diode ED. In this embodiment, an example in which one pixel PXij includes one light emitting diode ED will be described.

The (j−1)-th scan line GLj−1, the j-th scan line GLj, the (j+1)-th scan line GLj+1, and the j-th emission control line EMLj may transmit the (j−1)-th scan signal Gj−1, the j-th scan signal Gj, the (j+1)-th scan signal Gj+1, and the emission signal EMj, respectively. The i-th data line DLi transmits the data signal Di. The data signal Di may have a voltage level corresponding to the image signal RGB inputted to the display device DD (refer to FIG. 4). The first to third driving voltage lines VL1, VL2, and VL3 may transmit a first driving voltage ELVDD, a second driving voltage ELVSS, and an initialization voltage VINT, respectively.

The first transistor T1 includes a first electrode connected to the first driving voltage line VL1 through a fifth transistor T5, a second electrode electrically connected to the anode of the light emitting diode ED through the sixth transistor T6, and a gate electrode connected to one end of the capacitor Cst. The first transistor T1 may receive the data signal Di transmitted from the i-th data line DLi according to the switching operation of the second transistor T2 and supply the driving current Id to the light emitting diode ED.

The second transistor T2 includes a first electrode connected to the i-th data line DLi, a second electrode connected to the first electrode of the first transistor T1, and a gate electrode connected to the j-th scan line GLj. The second transistor T2 is turned on according to the j-th scan signal Gj received through the j-th scan line GLj, so that the second transistor T2 may transmit the data signal Di transmitted from the i-th data line DLi to the first electrode of the first transistor T1.

The third transistor T3 includes a first electrode connected to the gate electrode of the first transistor T1, a second electrode connected to the second electrode of the first transistor T1, and a gate electrode connected to the j-th scan line GLj. The third transistor T3 may be turned on according to the j-th scan signal Gj received through the j-th scan line GLj, and may diode-connect the first transistor T1 by connecting the gate electrode and the second electrode of the first transistor T1 to each other.

The fourth transistor T4 includes a first electrode connected to the gate electrode of the first transistor T1, a second electrode connected to the third driving voltage line VL3 through which the initialization voltage VINT is transmitted, and a gate electrode connected to the (j−1)-th scan line GLj−1. The fourth transistor T4 may be turned on according to the (j−1)-th scan signal Gj−1 received through the (j−1)-th scan line GLj−1 and may perform an initialization operation of initializing the voltage of the gate electrode of the first transistor T1 by transmitting the initialization voltage VINT to the gate electrode of the first transistor T1.

The fifth transistor T5 includes a first electrode connected to the first driving voltage line VL1, a second electrode connected to the first electrode of the first transistor T1, and a gate electrode connected to the j-th emission control line EMLj.

The sixth transistor T6 includes a first electrode connected to the second electrode of the first transistor T1, a second electrode connected to the anode of the light emitting diode ED, and a gate electrode connected to the j-th emission control line EMLj.

The fifth transistor T5 and the sixth transistor T6 are simultaneously turned on according to the emission signal EMj received through the j-th emission control line EMLj and through this, the first driving voltage ELVDD may be compensated through the diode-connected first transistor T1 and transmitted to the light emitting diode ED.

The seventh transistor T7 includes a first electrode connected to the second electrode of the fourth transistor T4, a second electrode connected to the second electrode of the sixth transistor T6, and a gate electrode connected to the (j+1)-th scan line GLj+1.

As described above, one end of the capacitor Cst is connected to the gate electrode of the first transistor T1 and the other end of the capacitor Cst is connected to the first driving voltage line VL1. The cathode of the light emitting diode ED may be connected to the second driving voltage line VL2 transmitting the second driving voltage ELVSS. The structure of the pixel PXij according to the embodiment is not limited to the structure illustrated in FIG. 5, and the number of transistors and the number of capacitors included in one pixel PXij, and a connection relationship can be variously modified.

Figure 6:
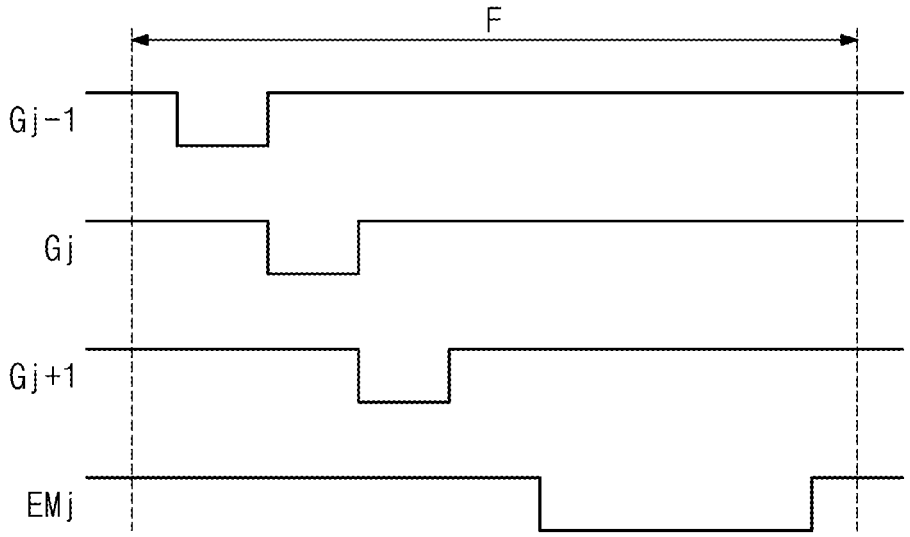
FIG. 6 is a timing diagram for explaining an operation of the pixel shown in FIG. 5.

FIG. 6 is a timing diagram for explaining an operation of the pixel shown in FIG. 5. An operation of the display device according to an embodiment will be described with reference to FIGS. 5 and 6.

Referring to FIGS. 5 and 6, the (j−1)-th scan signal Gj−1 of a low level is provided through the (j−1)-th scan line GLj−1 during an initialization period within one frame F. The fourth transistor T4 is turned on in response to the (j−1)-th scan signal Gj−1 of the low-level, and the initialization voltage VINT is transmitted to the gate electrode of the first transistor T1 through the fourth transistor T4, so that the first transistor T1 is initialized.

Next, when the j-th scan signal Gj of the low-level is supplied through the j-th scan line GLj during data programming and compensation period, the third transistor T3 is turned on. The first transistor T1 is diode-connected by the turned-on third transistor T3 and is biased in the forward direction. In addition, the second transistor T2 is turned on by the j-th scan signal Gj of the low-level. Then, a compensation voltage Di-Vth which amounts to a reduced voltage by the threshold voltage Vth of the first transistor T1 from the data signal Di is applied to the gate electrode of the first transistor T1. That is, the gate voltage applied to the gate electrode of the first transistor T1 may be the compensation voltage Di-Vth.

A first driving voltage ELVDD and a compensation voltage Di-Vth are applied to both ends of the capacitor Cst, respectively, and a charge corresponding to a voltage difference between both ends may be stored in the capacitor Cst.

The seventh transistor T7 is turned on by receiving the (j+1)-th scan signal Gj+1 of the low-level through the (j+1)-th scan line GLj+1. A portion (i.e., bypass current Ibp) of the driving current Id may escape through the seventh transistor T7.

Even when the minimum current of the first transistor T1 displaying a black image flows as the driving current Id, if the light emitting diode ED emits light, a black image is not properly displayed. Accordingly, the seventh transistor T7 in the pixel PXij according to an embodiment of the inventive concept may distribute a portion of the minimum current of the first transistor T1 as the bypass current Ibp to a current path other than the current path toward the light emitting diode ED. Here, the minimum current of the first transistor T1 means a current under a condition in which the first transistor T1 is turned off because the gate-source voltage of the first transistor T1 is less than the threshold voltage Vth. In this way, the minimum driving current (e.g., a current of 10 picoamperes (pA) or less) under the condition of turning off the first transistor T1 is transmitted to the light emitting diode ED, and is expressed as an image of black luminance. It can be said that when the minimum driving current Id to display a black image flows, the effect of bypass transmission of the bypass current Ibp is large, but when a large driving current Id that displays an image such as a normal or white image flows, there is little effect of the bypass current Ibp. Therefore, when the driving current Id for displaying a black image flows, the emission current led of the light emitting diode ED, which is reduced by the amount of the bypass current Ibp escaped from the driving current Id through the seventh transistor T7, has the minimum amount of current at a level that can reliably represent a black image. Accordingly, an accurate black luminance image may be implemented using the seventh transistor T7 to improve a contrast ratio. In this embodiment, the bypass signal is the (j+1)-th scan signal Gj+1 of the low-level, but is not limited thereto.

Next, during the emission period, the emission signal EMj supplied from the j-th emission control line EMLj is changed from the high level to the low level. During the emission period, the fifth transistor T5 and the sixth transistor T6 are turned on by the low-level emission signal EMj. Then, a driving current Id according to the voltage difference between the gate voltage of the gate electrode of the first transistor T1 and the first driving voltage ELVDD is generated, and the driving current Id is supplied to the light emitting diode ED through the sixth transistor T6, so that the emission current led flows through the light emitting diode ED.

Figure 7:
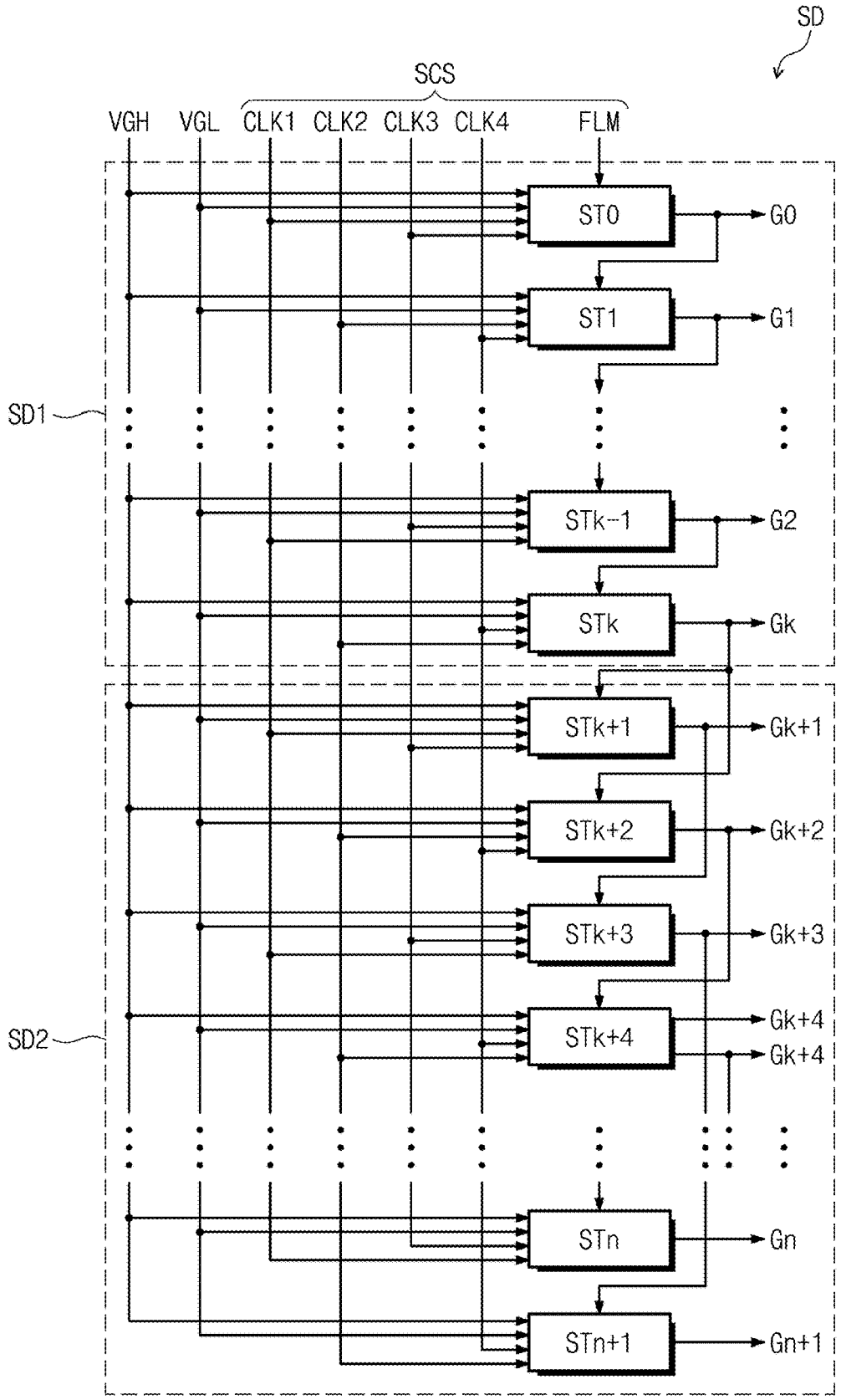
FIG. 7 is a block diagram of a scan driving circuit according to an embodiment of the inventive concept.

FIG. 7 is a block diagram of a scan driving circuit SD according to an embodiment of the inventive concept.

Referring to FIG. 7, the scan driving circuit SD includes a first scan driving circuit SD1 and a second scan driving circuit SD2. The first scan driving circuit SD1 may correspond to the first display area DA1 (refer to FIG. 1A), and the second scan driving circuit SD2 may correspond to the second display area DA2 (refer to FIG. 1A). The first scan driving circuit SD1 includes driving stages ST0 to STk, and the second scan driving circuit SD2 includes driving stages STk+1 to STn+1.

Each of the driving stages ST0 to STn+1 receives a scan control signal SCS from the driving controller 100 illustrated in FIG. 4. The scan control signal SCS includes a start signal FLM, a first clock signal CLK1, a second clock signal CLK2, a third clock signal CLK3, and a fourth clock signal CLK4. Each of the driving stages ST0 to STn+1 receives a first voltage VGL and a second voltage VGH. The first voltage VGL and the second voltage VGH may be provided from the voltage generator 300 illustrated in FIG. 4.

In an embodiment, the driving stages ST0 to STn+1 output scan signals G0 to Gn+1, respectively. The scan signals G0 to Gn+1 may be provided to the scan lines GL0 to GLn+1 shown in FIG. 4, respectively.

The driving stages ST0 to STk in the first scan driving circuit SD1 receive corresponding two clock signals among the first to fourth clock signals CLK1 to CLK4. When k is an even number, for example, the driving stages ST0, ST2, ST4, ST6, . . . , STk receive the first clock signal CLK1 and the third clock signal CLK3. The driving stages ST1, ST3, ST5, ST7, . . . , STk−1 receive the second clock signal CLK2 and the fourth clock signal CLK4. In the case that k is an odd number, the driving stages ST0, ST2, ST4, ST6, . . . , STk−1 receive the first clock signal CLK1 and the third clock signal CLK3, and the driving stages ST1, ST3, ST5, ST7, . . . , STk receive the second clock signal CLK2 and the fourth clock signal CLK4 as the sample shown in FIG. 7.

The driving stage ST0, which is the first driving stage in the first scan driving circuit SD1, may receive the start signal FLM as a carry signal. Each of the driving stages ST1 to STk in the first scan driving circuit SD1 has a dependent connection relationship in which a scan signal outputted from the previous driving stage is received as a carry signal. For example, the driving stage ST1 receives the scan signal G0 outputted from the previous driving stage ST0 as a carry signal, and the driving stage ST2 receives the scan signal G1 outputted from the previous driving stage ST1 as a carry signal.

Both the first driving stage, which is the driving stage STk+1, and the second driving stage, which is the driving stage STk+2, in the second scan driving circuit SD2 receive the scan signal Gk outputted from the driving stage STk, which is the last driving stage in the first scan driving circuit SD1, as a carry signal.

Odd-numbered driving stages among the driving stages STk+1 to STn+1 in the second scan driving circuit SD2 may be referred to as the first driving stages, and even-numbered driving stages may be referred to as second driving stages. For example, when the total number of the driving stages included in the second scan driving circuit SD2 is an even number, the driving stages STk+1, STk+3, STk+5, . . . , STn are the first driving stages, and the driving stages STk+2, STk+4, STk+6, . . . , STn+1 are the second driving stages. When the total number of the driving stages included in the second scan driving circuit SD2 is an odd number, the driving stages STk+1, STk+3, STk+5, . . . , STn+1 are the first driving stages, and the driving stages STk+2, STk+4, STk+6, . . . , STn are the second driving stages. Hereinafter, the case that the total number of the driving stages included in the second scan driving circuit SD2 is an even number is assumed.

Each of the first driving stages STk+3, STk+5, . . . , STn has a dependent connection relationship in which a scan signal outputted from the previous first driving stage is received as a carry signal. For example, the first driving stage STk+3 receives the scan signal Gk+1 outputted from the previous first driving stage STk+1 as a carry signal, and the driving stage STk+5 receives the scan signal Gk+3 outputted from the previous first driving stage STk+3 as a carry signal. Each of the first driving stages STk+1, STk+3, STk+5, . . . , STn receives a first clock signal CLK1 and a third clock signal CLK3. The first driving stages STk+1, STk+3, STk+5, . . . , STn may output the first scan signals Gk+1, Gk+3, Gk+5, . . . , Gn to the first scan lines GLk+1, GLk+3, GLk+5, . . . , GLn, respectively (see FIG. 4).

Each of the second driving stages STk+4, STk+6, . . . , STn+1 has a dependent connection relationship in which a scan signal outputted from the previous second driving stage is received as a carry signal. For example, the second driving stage STk+4 receives the scan signal Gk+2 outputted from the previous second driving stage STk+2 as a carry signal, and the driving stage STk+6 receives the scan signal Gk+4 outputted from the previous second driving stage STk+4 as a carry signal. Each of the second driving stages STk+2, STk+4, STk+6, . . . , STn+1 receives a second clock signal CLK2 and a fourth clock signal CLK4.

The second driving stages STk+2, STk+4, STk+6, . . . , STn+1 may output the second scan signals Gk+2, Gk+4, Gk+6, . . . , Gn+1 to the second scan lines GLk+2, GLk+4, GLk+6, . . . , GLn+1, respectively (see FIG. 4).

Figure 8:
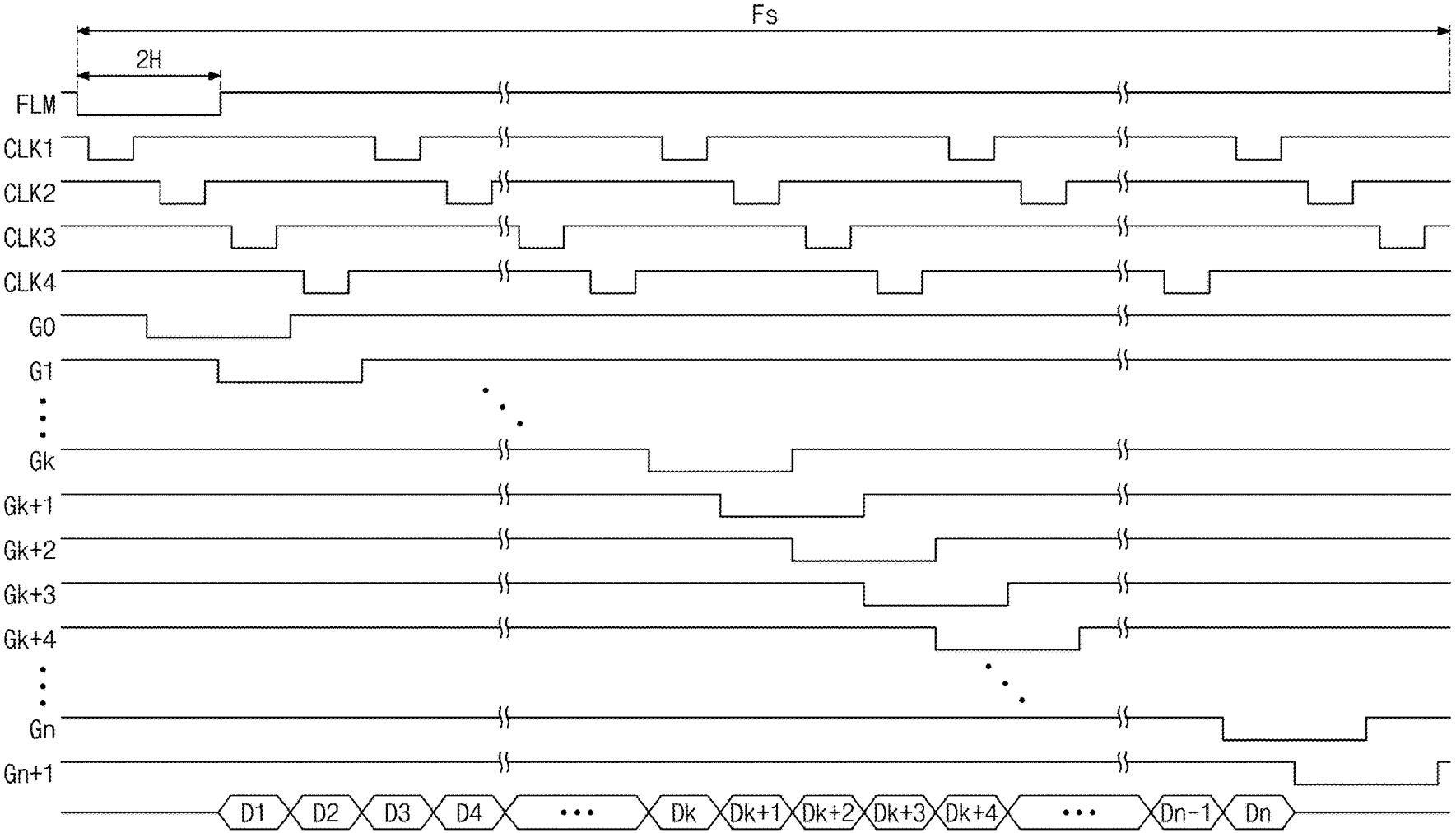
FIG. 8 is a diagram for describing an operation of the scan driving circuit shown in FIG. 7 in a normal frequency mode.

FIG. 8 is a diagram for describing an operation of the scan driving circuit shown in FIG. 7 in a normal frequency mode.

Referring to FIGS. 4, 7 and 8, the driving controller 100 sequentially activates the first to fourth clock signals CLK1 to CLK4 to a low level during the normal frequency mode.

During a normal frequency mode, the driving stages ST0 to STn+1 sequentially may activate the scan signals G0 to Gn+1 to a low level in response to the start signal FLM and the first to fourth clock signals CLK1 to CLK4.

The data driving circuit 200 may sequentially provide the data signals D1 to Dn to the data lines DL1 to DLm. For example, the data signal D1 is a data signal to be provided to the pixels PX in one row connected to the scan line GL1, and the data signal Dn is a data signal to be provided to the pixels PX in one row connected to the scan line GLn.

The activation period (e.g., low level period) of the start signal FLM is 2 horizontal periods 2H. One horizontal period is a time when pixels in one row are driven.

Figure 9A:
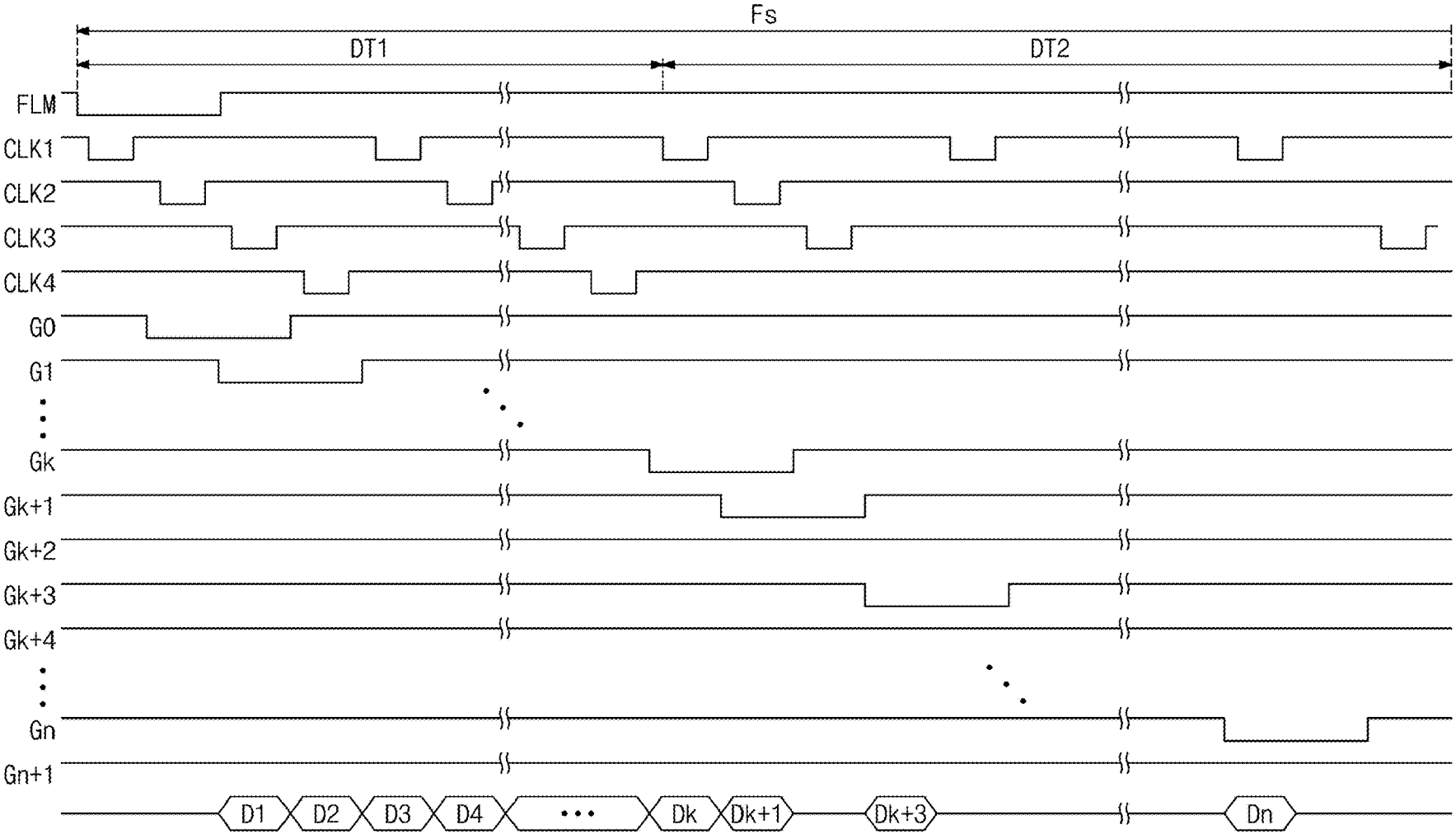
FIG. 9A is a diagram for explaining an operation of the scan driving circuit shown in FIG. 7 in a first frame in a multi-frequency mode.
Figure 9B:
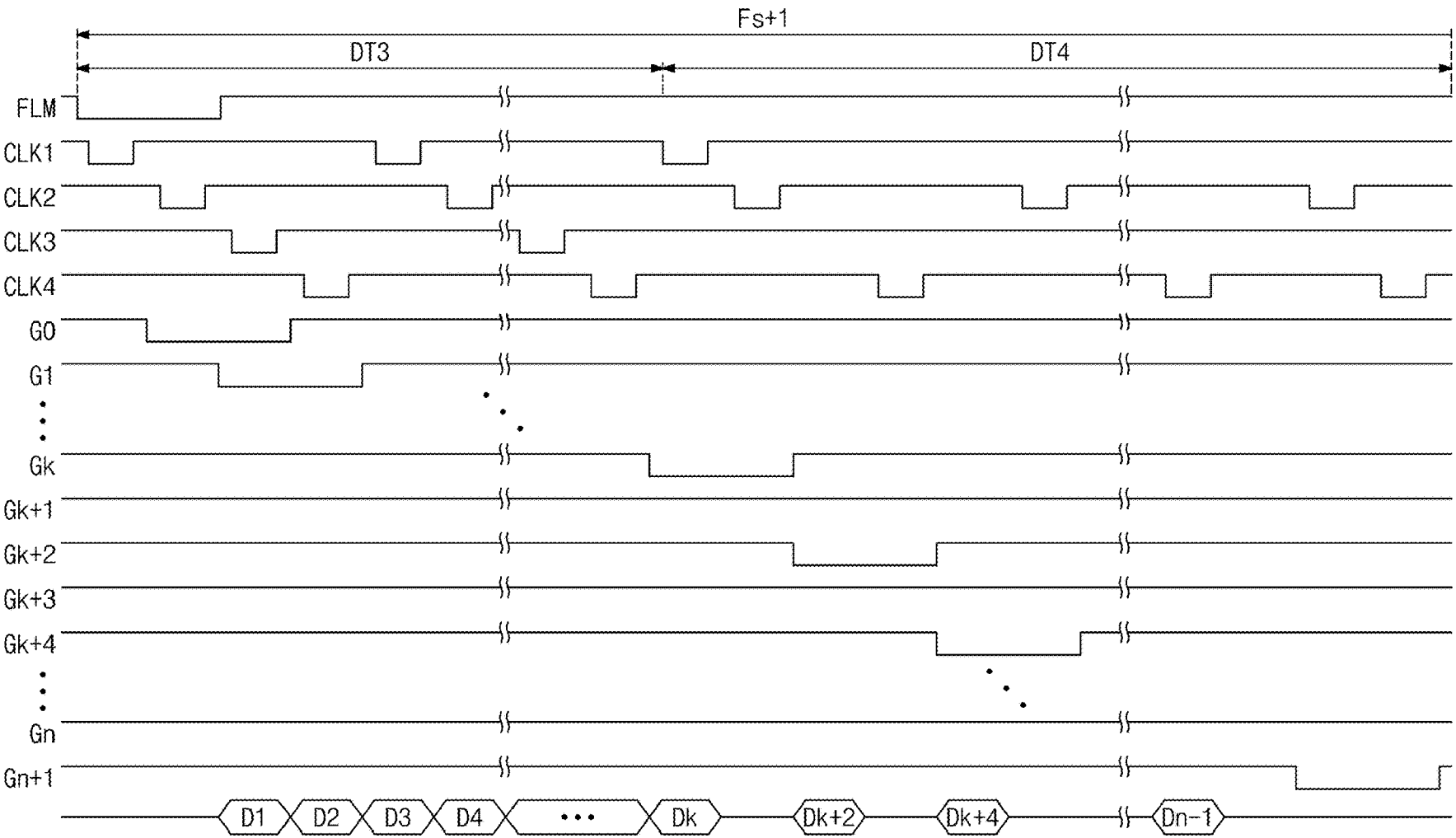
FIG. 9B is a diagram for explaining an operation of the scan driving circuit shown in FIG. 7 in a second frame in a multi-frequency mode.

FIG. 9A is a diagram for explaining an operation of the scan driving circuit shown in FIG. 7 in a first frame Fs in a multi-frequency mode. FIG. 9B is a diagram for explaining the operation of the scan driving circuit shown in FIG. 7 in the second frame Fs+1 in the multi-frequency mode. The second frame Fs+1 is a frame that is temporally consecutive with the first frame Fs.

First, referring to FIGS. 4, 7 and 9A, a first frame Fs in a multi-frequency mode includes a first driving period DT1 and a second driving period DT2. The first driving period DT1 is a time when the first display area DA1 (see FIG. 1) is driven, and the second driving period DT2 is a time when the second display area DA2 (see FIG. 1) is driven.

The driving controller 100 sequentially activates the first to fourth clock signals CLK1 to CLK4 to a low level during the first driving period DT1 in the first frame Fs in the multi-frequency mode.

Accordingly, during the first driving period DT1 in the first frame Fs of the multi-frequency mode, the driving stages ST0 to STk may sequentially activate the scan signals G0 to Gk to a low level in response to the start signal FLM and the first to fourth clock signals CLK1 to CLK4.

The data driving circuit 200 may sequentially provide the data signals D1 to Dk to the data lines DL1 to DLm during the first driving period DT1 in the first frame Fs of the multi-frequency mode. For example, the data signal D1 is a data signal to be provided to the pixels PX in one row connected to the scan line GL1, and the data signal Dk is a data signal to be provided to the pixels PX in one row connected to the scan line GLk.

Accordingly, during the first driving period DT1 in the first frame Fs in the multi-frequency mode, the first display area DA1 (see FIG. 1) may display an image.

The driving controller 100 outputs the first clock signal CLK1 and the third clock signal CLK3 during the second driving period DT2 in the first frame Fs in the multi-frequency mode. The frequencies of the first and third clock signals CLK1 and CLK3 in the second driving period DT2 are the same as those of the first driving period DT1. Therefore, the first driving stages STk+1, STk+3, STk+5, . . . , STn may output the first scan signals Gk+1, Gk+3, Gk+5, . . . , Gn of an active level (e.g., a low level) to the first scan lines GLk+1, GLk+3, GLk+5, . . . , GLn.

The driving controller 100 maintains the second clock signal CLK2 and the fourth clock signal CLK4 at an inactive level (e.g., a high level) during the second driving period DT2 in the first frame Fs of the multi-frequency mode. As the second clock signal CLK2 and the fourth clock signal CLK4 are maintained at an inactive level, the second driving stages STk+2, STk+4, STk+6, . . . , STn+1 do not operate. Therefore, the second scan signals Gk+2, Gk+4, Gk+6, . . . , Gn+1 provided to the second scan lines GLk+2, GLk+4, GLk+6, . . . , GLn+1 (see FIG. 4) may be maintained at an inactive level (e.g., a high level).

The data driving circuit 200 may sequentially provide data signals Dk+1, Dk+3, Dk+3, . . . , Dn to the data lines DL1 to DLm during the second driving period DT2 in the first frame Fs of the multi-frequency mode.

Therefore, during the second driving period DT2 in the first frame Fs of the multi-frequency mode, the pixels PX connected to the first scan lines GLk+1, GLk+3, GLk+5, . . . , GLn display an image, and the pixels PX connected to the second scan lines GLk+2, GLk+4, GLk+6, . . . , GLn+1 do not display an image.

Referring to FIGS. 4, 7 and 9B, a second frame Fs+1 in a multi-frequency mode includes a third driving period DT3 and a fourth driving period DT4. The third driving period DT3 is a time when the first display area DA1 (refer to FIG. 1) is driven, and the fourth driving period DT4 is a time when the second display area DA2 (refer to FIG. 1) is driven.

The driving controller 100 sequentially activates the first to fourth clock signals CLK1 to CLK4 to a low level during the third driving period DT3 in the second frame Fs+1 in the multi-frequency mode.

Accordingly, during the third driving period DT3 in the second frame Fs+1 of the multi-frequency mode, the driving stages ST0 to STk may sequentially activate the scan signals G0 to Gk to a low level in response to the start signal FLM and the first to fourth clock signals CLK1 to CLK4.

The data driving circuit 200 may sequentially provide the data signals D1 to Dk to the data lines DL1 to DLm during the third driving period DT3 in the second frame Fs+1 of the multi-frequency mode.

Therefore, during the third driving period DT3 in the second frame Fs+1 in the multi-frequency mode, the first display area DA1 (refer to FIG. 1) may display an image.

The driving controller 100 outputs the second clock signal CLK2 and the fourth clock signal CLK4 during the fourth driving period DT4 in the second frame Fs+1 in the multi-frequency mode. In the fourth driving period DT4, the frequencies of the second and fourth clock signals CLK2 and CLK4 are the same as those of the third driving period DT3. Therefore, the second driving stages STk+2, STk+4, STk+6, . . . , STn+1 may output the second scan signals Gk+2, Gk+4, Gk+5, . . . , Gn+1 of the active level (e.g., low level) to the second scan lines GLk+2, GLk+4, GLk+6, . . . , GLn+1.

The driving controller 100 maintains the first clock signal CLK1 and the third clock signal CLK3 at an inactive level (e.g., a high level) during the fourth driving period DT4 in the second frame Fs+1 of the multi-frequency mode. As the first clock signal CLK1 and the third clock signal CLK3 are maintained at an inactive level, the first driving stages STk+1, STk+3, STk+5, . . . , STn do not operate. Accordingly, the first scan signals Gk+1, Gk+3, Gk+5, . . . , Gn provided to the first scan lines GLk+1, GLk+3, GLk+5, . . . , GLn may be maintained at an inactive level (e.g., a high level).

The data driving circuit 200 may sequentially provide data signals Dk+2, Dk+4, Dk+5, . . . , Dn+1 to the data lines DL1 to DLm during the fourth driving period DT4 in the second frame Fs+1 of the multi-frequency mode.

Therefore, during the fourth driving period DT4 in the second frame Fs+1 of the multi-frequency mode, the pixels PX connected to the first scan lines GLk+1, GLk+3, GLk+5, . . . , GLn do not display an image, and the pixels PX connected to the second scan lines GLk+2, GLk+4, GLk+6, . . . , GLn+1 may display an image.

During multi-frequency mode, the display device DD alternately operates with the first frame Fs shown in FIG. 9A and the second frame Fs+1 shown in FIG. 9B to display an image on the display panel DP.

Figure 10:
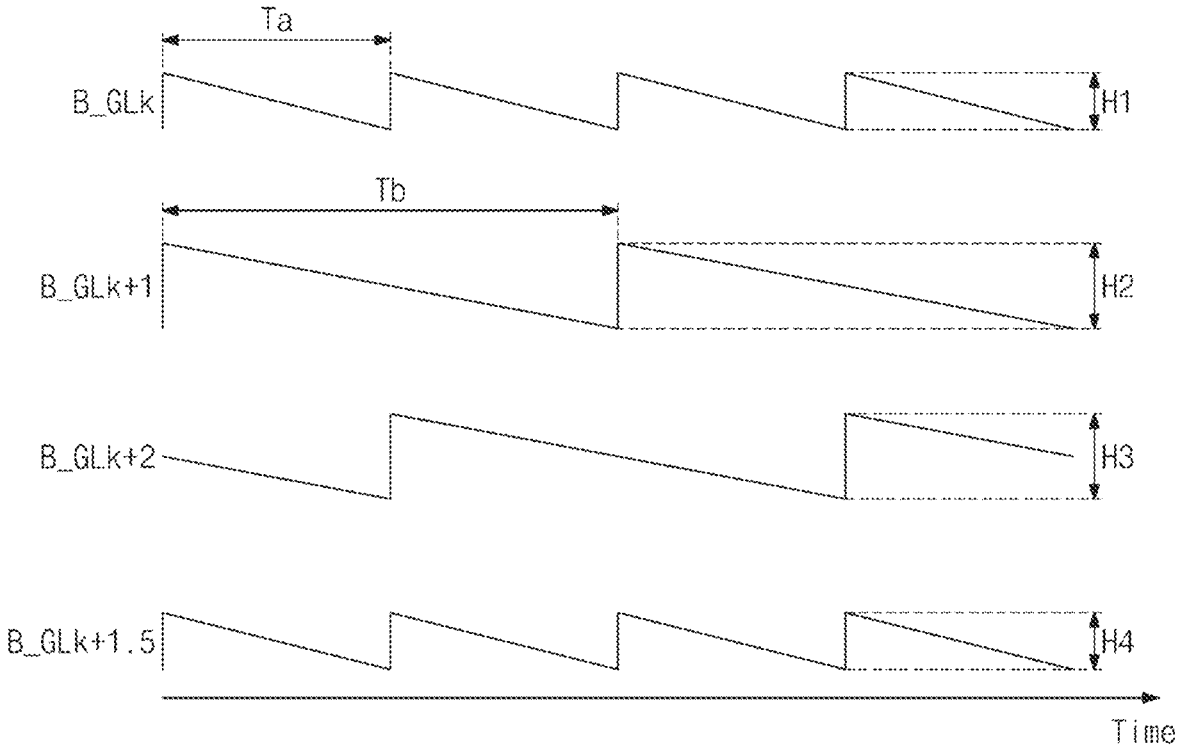
FIG. 10 is a diagram illustrating a change in luminance according to an operation mode.

FIG. 10 is a diagram illustrating a change in luminance according to an operation mode.

Referring to FIGS. 4 and 10, pixels PX connected to the k-th scan line GLk in the first display area DA1 display an image at a first driving frequency (e.g., 60 Hz) in a multi-frequency mode.

After the current corresponding to the data signal Di is supplied to the light emitting diode ED (see FIG. 5), during the period Ta of one frame, the luminance B_GLk of the pixels PX connected to the k-th scan line GLk gradually decreases so that the luminance B_GLk reaches the minimum luminance, and rises again to the maximum luminance in the next frame (luminance difference is H1).

The pixels PX connected to the odd-numbered scan lines, for example, the (k+1)-th scan line GLk+1, in the second display area DA2, may display an image at a second driving frequency (e.g., 30 Hz) in the multi-frequency mode.

In the same manner, the pixels PX connected to the even-numbered scan lines, for example, the (k+2)-th scan line GLk+2, in the second display area DA2, may display an image at a second driving frequency (e.g., 30 Hz) in a multi-frequency mode.

During the period Tb of one frame, the luminance B_GLk+1 of the pixels PX connected to the (k+1)-th scan line GLk+1 decreases to reach the minimum luminance, and thus reaches the minimum luminance and then rises back to the maximum luminance in the next frame (luminance difference is H2). Here, the period Tb is two times of the period Ta. During the period Tb of one frame, the luminance B_GLk+2 of the pixels PX connected to the (k+2)-th scan line GLk+2 decreases to reach the minimum luminance, and thus rises back to the maximum luminance in the next frame (luminance difference is H3).

In general, when a current corresponding to the same data signal Di is supplied to the light emitting diode ED, as the period of one frame is longer, the difference in luminance within one frame increases (H1<H2, H1<H3).

As described in FIG. 7, since first scan lines GLk+1, GLk+3, GLk+5, . . . , GLn and second scan lines GLk+2, GLk+4, GLk+6, . . . , GLn+1 are alternately arranged in the second direction DR2, the luminance B_GLk+1 of the pixels PX connected to the (k+1)-th scan line GLk+1 and the luminance B_GLk+2 of the pixels PX connected to the (k+2)-th scan line GLk+2 may be recognized by a user as the luminance B_GLk+1.5 corresponding to the first driving frequency (e.g., 60 Hz). The luminance difference H4 of the luminance B_GLk+1.5 is close to the luminance difference H1 of the pixels PX connected to the k-th scan line GLk in the first display area DA1.

Figure 11:
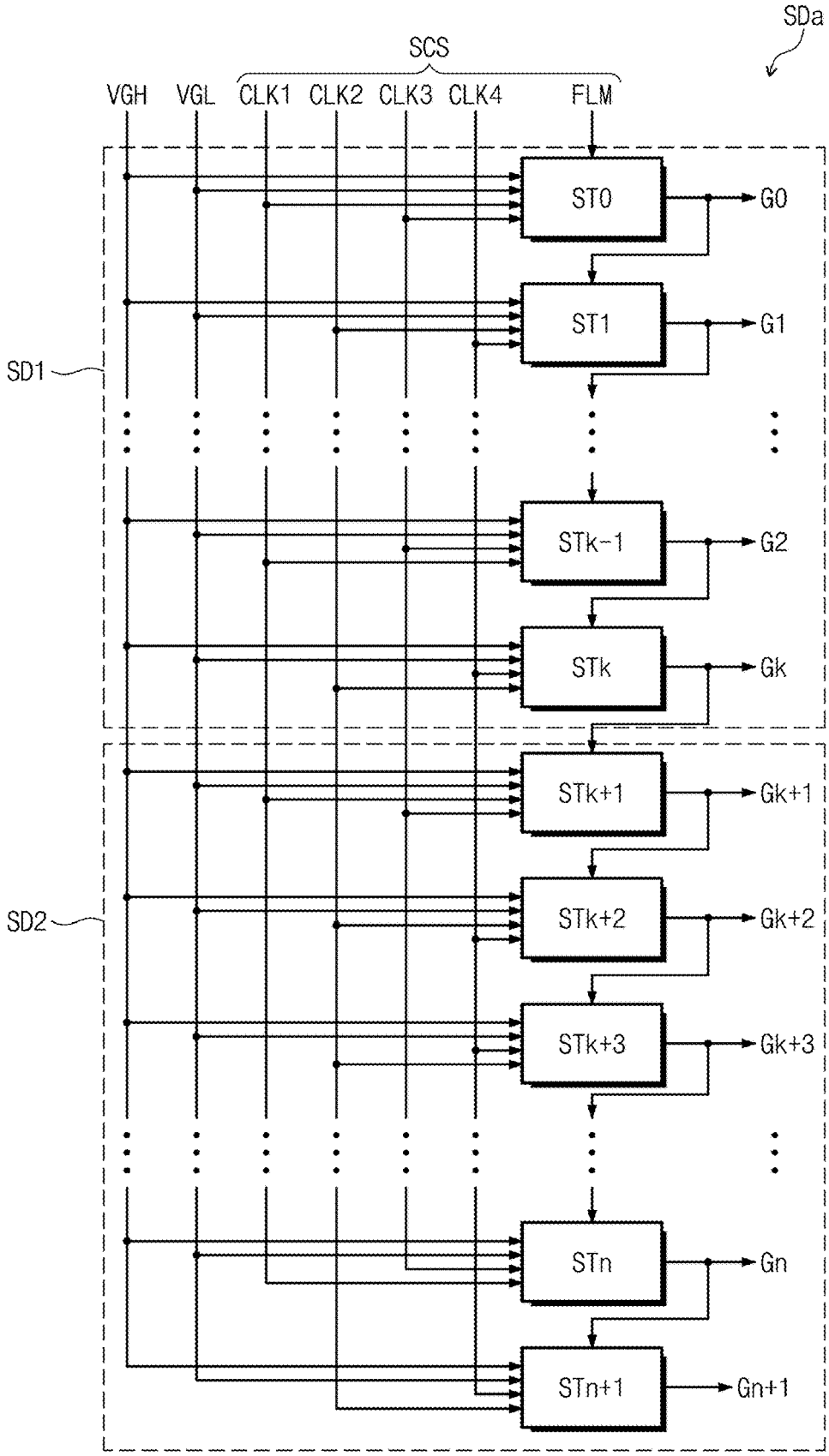
FIG. 11 is a block diagram of a scan driving circuit according to another embodiment of the inventive concept.

FIG. 11 is a block diagram of a scan driving circuit SDa according to another embodiment of the inventive concept.

Referring to FIG. 11, the scan driving circuit SDa includes a first scan driving circuit SD1 and a second scan driving circuit SD2. The first scan driving circuit SD1 may correspond to the first display area DA1 (refer to FIG. 1A), and the second scan driving circuit SD2 may correspond to the second display area DA2 (refer to FIG. 1A). The first scan driving circuit SD1 includes driving stages ST0 to STk, and the second scan driving circuit SD2 includes driving stages STk+1 to STn+1.

Each of the driving stages ST0 to STn+1 receives a scan control signal SCS from the driving controller 100 illustrated in FIG. 4. The scan control signal SCS includes a start signal FLM, a first clock signal CLK1, a second clock signal CLK2, a third clock signal CLK3, and a fourth clock signal CLK4. Each of the driving stages ST0 to STn+1 receives a first voltage VGL and a second voltage VGH. The first voltage VGL and the second voltage VGH may be provided from the voltage generator 300 illustrated in FIG. 4.

In an embodiment, the driving stages ST0 to STn+1 output scan signals G0 to Gn+1, respectively. The scan signals G0 to Gn+1 may be provided to the scan lines GL0 to GLn+1 shown in FIG. 4, respectively.

The driving stages ST0 to STn+1 receive corresponding two clock signals among the first to fourth clock signals CLK1 to CLK4. When n is an even number, for example, the driving stages ST0, ST2, ST4, ST6, . . . , STn receive a first clock signal CLK1 and a third clock signal CLK3. The driving stages ST1, ST3, ST5, ST7, . . . , STn+1 receive the second clock signal CLK2 and the fourth clock signal CLK4 as the sample shown in FIG. 11. In the case that n is an odd number, the driving stages ST0, ST2, ST4, ST6, . . . , STn+1 receive the first clock signal CLK1 and the third clock signal CLK3, and the driving stages ST1, ST3, ST5, ST7, . . . , STn receive the second clock signal CLK2 and the fourth clock signal CLK4.

The driving stage ST0 may receive the start signal FLM as a carry signal. Each of the driving stages ST1 to STn+1 has a dependent connection relationship in which a scan signal outputted from the previous driving stage is received as a carry signal. For example, the driving stage ST1 receives the scan signal G0 outputted from the previous driving stage ST0 as a carry signal, and the driving stage ST2 receives the scan signal G1 outputted from the previous driving stage ST1 as a carry signal.

Figure 12:
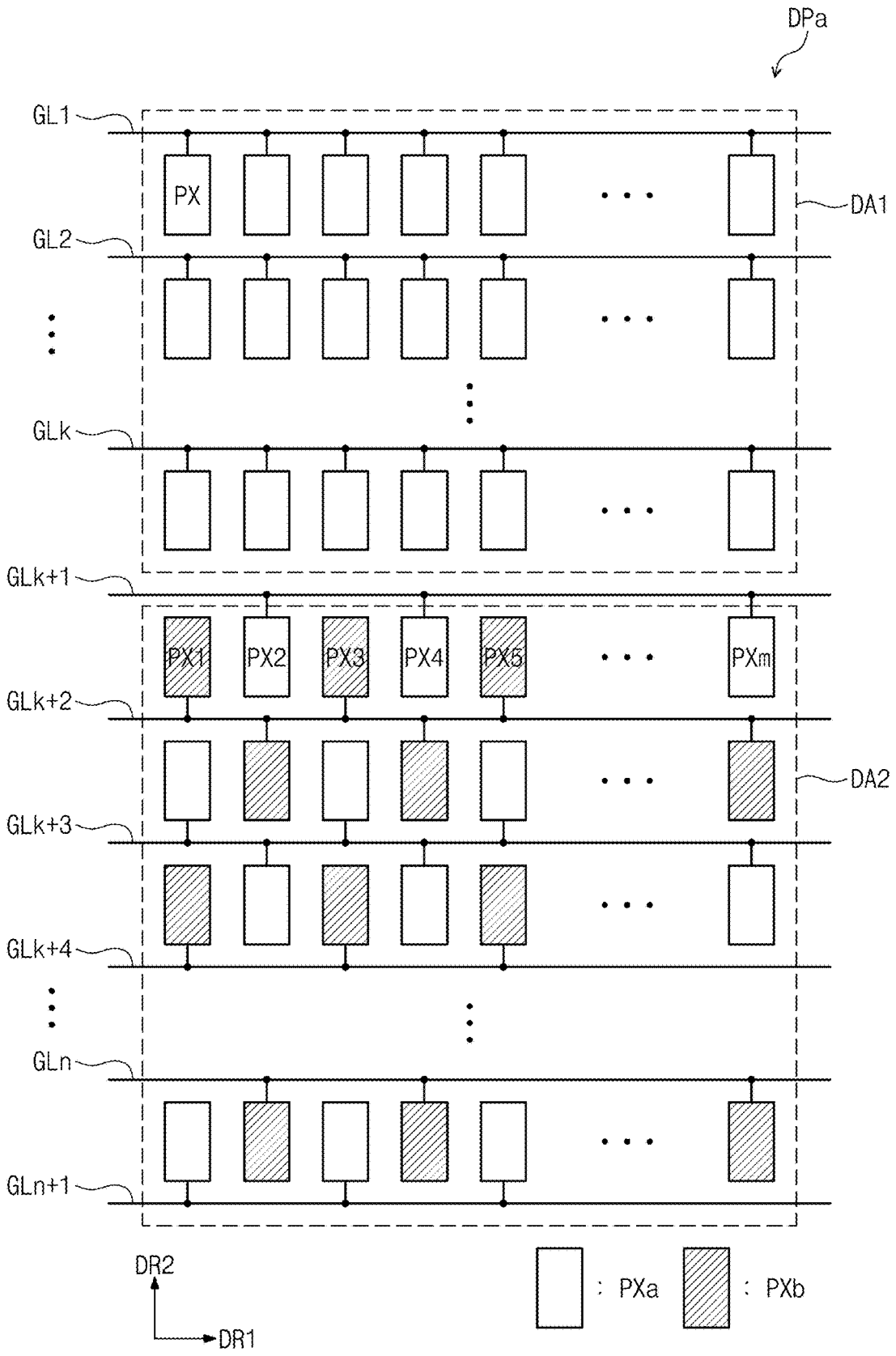
FIG. 12 is a diagram illustrating connections between pixels and scan lines of a display panel according to an embodiment of the inventive concept.

FIG. 12 is a diagram illustrating connections between pixels and scan lines of a display panel according to an embodiment of the inventive concept.

Referring to FIG. 12, the display panel DPa may be divided into a first display area DA1 and a second display area DA2. In the normal frequency mode NFM (refer to FIG. 3), the first display area DA1 and the second display area DA2 are driven with a normal frequency (e.g., 60 Hz). In the multi-frequency mode, the first display area DA1 may be driven with a first driving frequency, and the second display area DA2 may be driven with a second driving frequency lower than the first driving frequency.

The pixels in one row of the pixels PX of the first display area DA1 are connected to adjacent, same scan lines. For example, the pixels PX in the first row are connected to the scan line GL1, the pixels PX in the second row are connected to the scan line GL2, and the pixels PX in the k-th row are connected to the scan line GLk.

Some of the pixels in one row of the pixels PX of the second display area DA2 are connected to an adjacent first scan line, and others of the pixels in one row of the pixels PX of the second display area DA2 are connected to an adjacent second scan line. For example, the pixels PX1, PX3, PX5, . . . , PXm−1 disposed in the same row in the first direction DR1 are connected to a second scan line (i.e., GLk+2) disposed below the pixel. The pixels PX2, PX4, PX6, . . . , PXm disposed in the same row in the first direction DR1 are connected to the first scan line (i.e., GLk+1) disposed above the pixel.

Figure 13:
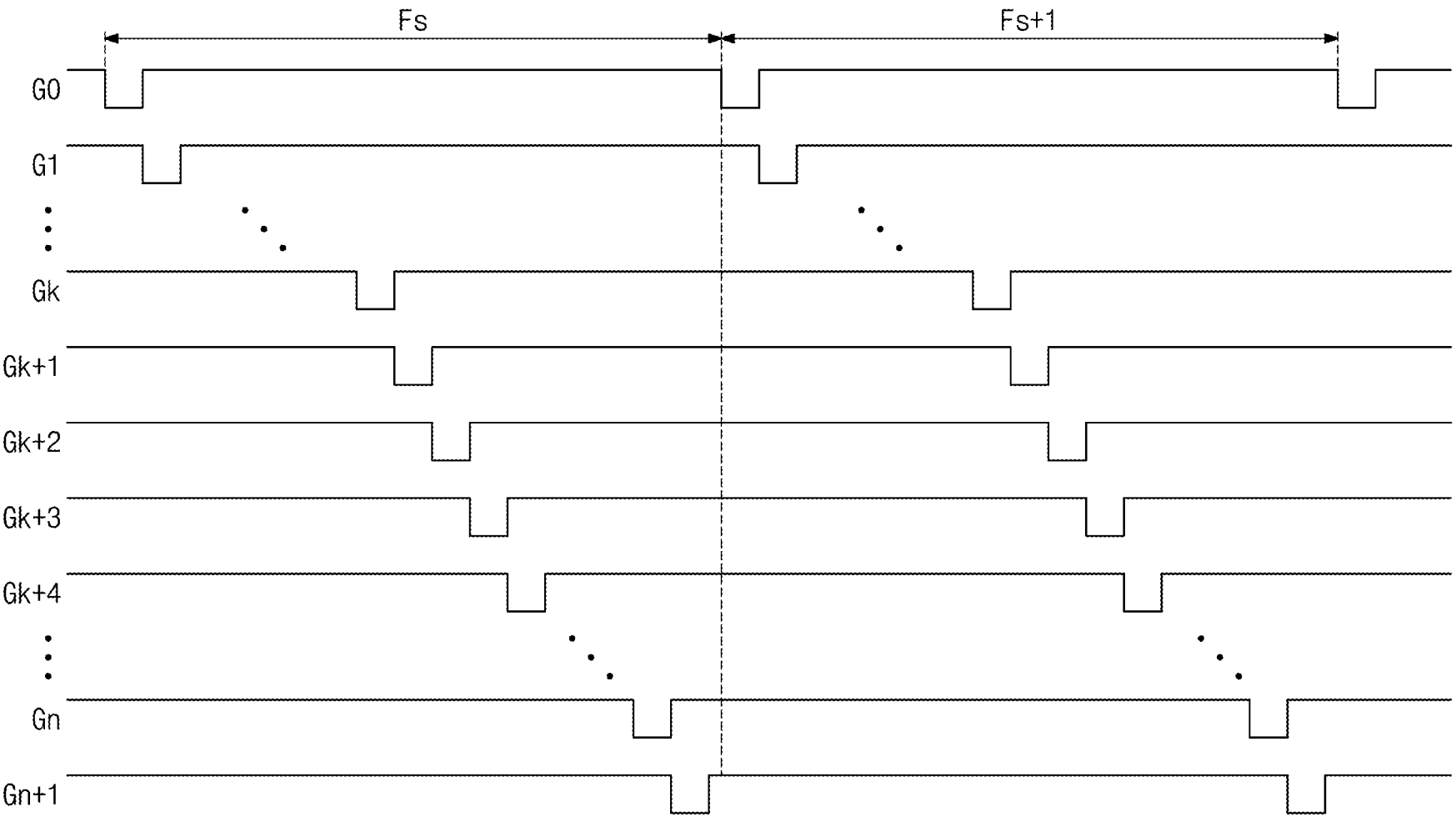
FIG. 13 is a diagram for describing operations of the scan driving circuit illustrated in FIG. 11 and the display panel illustrated in FIG. 12 in a normal frequency mode.

FIG. 13 is a diagram for describing operations of the scan driving circuit SDa illustrated in FIG. 11 and the display panel DPa illustrated in FIG. 12 in a normal frequency mode.

Referring to FIGS. 11, 12 and 13, in each of the first frame Fs and the second frame Fs+1 of the normal frequency mode, the driving stages ST0 to STn+1 may sequentially activate the scan signals G0 to Gn+1 to a low level in response to the start signal FLM and the first to fourth clock signals CLK1 to CLK4. Accordingly, all the pixels arranged on the display panel DPa may display an image every frame.

Figure 14:
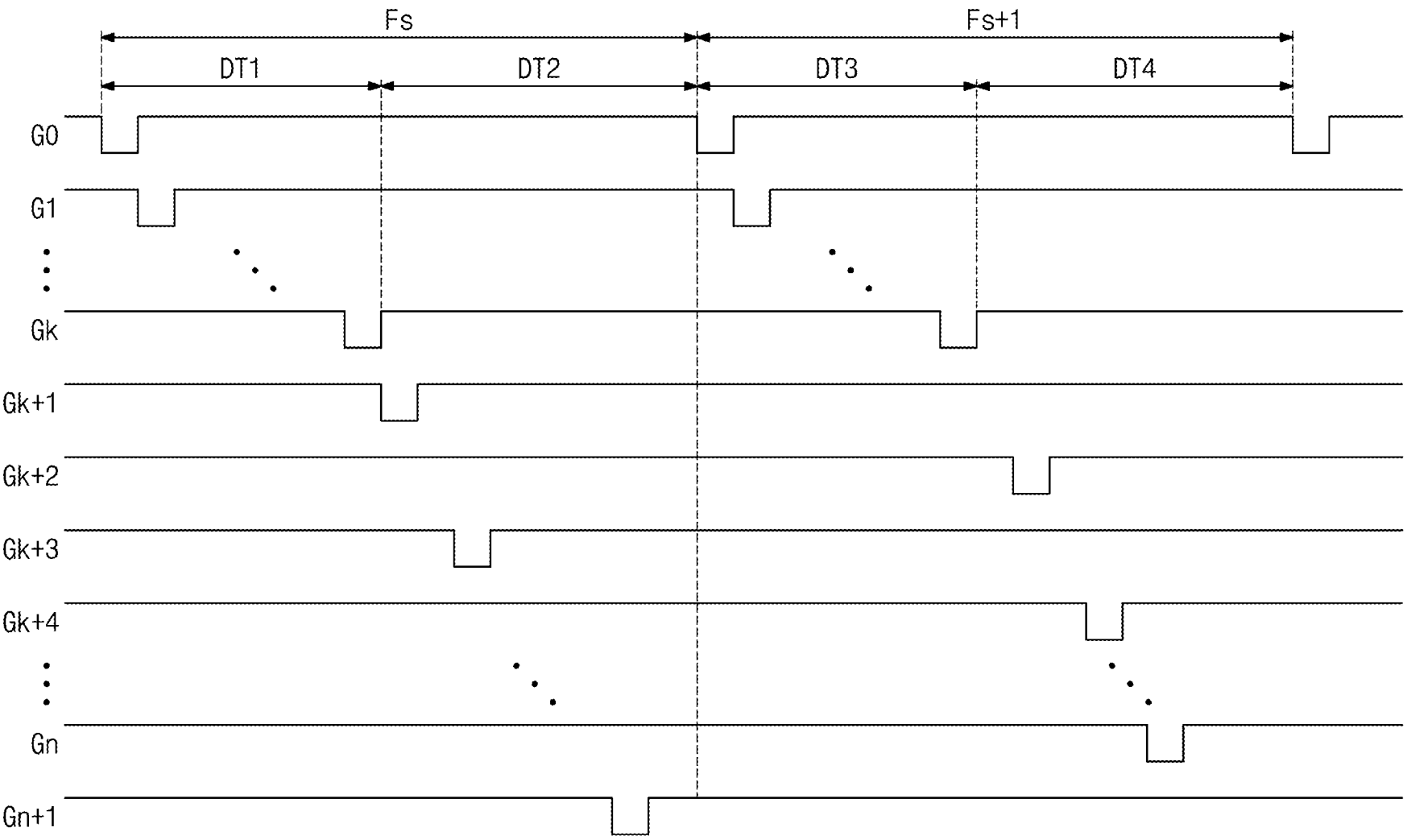
FIG. 14 is a diagram for explaining operations of the scan driving circuit shown in FIG. 11 and the display panel shown in FIG. 12 in a multi-frequency mode.

FIG. 14 is a diagram for describing operations of the scan driving circuit SDa shown in FIG. 11 and the display panel DPa shown in FIG. 12 in a multi-frequency mode.

Referring to FIGS. 11, 12, and 14, during the first driving period DT1 of the first frame Fs in the multi-frequency mode, the driving stages ST0 to STk may sequentially activate the scan signals G0 to Gk to a low level in response to the start signal FLM and the first to fourth clock signals CLK1 to CLK4. Accordingly, during the first driving period DT1 in the first frame Fs in the multi-frequency mode, the first display area DA1 (see FIG. 1) may display an image.

The driving controller 100 outputs the first clock signal CLK1 and the third clock signal CLK3 during the second driving period DT2 in the first frame Fs in the multi-frequency mode, and maintains the second clock signal CLK2 and the fourth clock signal CLK4 at an inactive level (e.g., a high level) (see FIG. 9A).

During the second driving period DT2, the first driving stages STk+1, STk+3, STk+5, . . . , STn among the driving stages STk+1 to STn+1 shown in FIG. 11 may sequentially output the first scan signals Gk+1, Gk+3, Gk+5, . . . , Gn+1 of an active level (e.g., low level) to the first scan lines GLk+1, GLk+3, GLk+5, . . . , GLn+1, respectively. Since the second driving stages STk+2, STk+4, STk+6, . . . , STn+1 among the driving stages STk+1-STn+1 do not operate, the second scan signals Gk+2, Gk+4, Gk+6, . . . , Gn provided to the second scan lines GLk+2, GLk+4, GLk+6, . . . , GLn may be maintained at an inactive level (e.g., a high level) during the second driving period DT2.

During the third driving period DT3 of the second frame Fs+1 of the multi-frequency mode, the driving stages ST0 to STk may sequentially activate the scan signals G0 to Gk to a low level in response to the start signal FLM and the first to fourth clock signals CLK1 to CLK4. Therefore, during the third driving period DT3 in the second frame Fs+1 in the multi-frequency mode, the first display area DA1 (refer to FIG. 1) may display an image.

The driving controller 100 outputs the second clock signal CLK2 and the fourth clock signal CLK4 during the fourth driving period DT4 in the second frame Fs+1 of the multi-frequency mode, and maintains the first clock signal CLK1 and the third clock signal CLK3 at an inactive level (e.g., a high level) (see FIG. 9B).

During the fourth driving period DT4, the second driving stages STk+2, STk+4, STk+6, STn among the driving stages STk+1 to STn+1 shown in FIG. 11 may sequentially output the second scan signals Gk+2, Gk+4, Gk+6, . . . , Gn of the active level (e.g., low level) to the second scan lines GLk+2, GLk+4, GLk+6, . . . , GLn+1. Since the first driving stages STk+1, STk+3, STk+5, . . . , STn+1 among the driving stages STk+1 to STn+1 do not operate, first scan signals Gk+1, Gk+3, Gk+5, . . . , Gn+1 provided to the first scan lines GLk+1, GLk+3, GLk+5, . . . , GLn+1 may be maintained at an inactive level (e.g., a high level) during the fourth driving period DT4.

During the second driving period DT2 in the first frame Fs of the multi-frequency mode, the first pixels PXa connected to the first scan lines GLk+1, GLk+3, GLk+5, . . . , GLn+1 among pixels in the second display area DA2 of the display panel DPa display an image, and the second pixels PXb connected to the second scan lines GLk+2, GLk+4, GLk+6, . . . , GLn do not display an image.

In addition, during the fourth driving period DT4 in the second frame Fs+1 of the multi-frequency mode, among the pixels in the second display area DA2 of the display panel DPa, the second pixels PXb connected to the second scan lines GLk+2, GLk+4, GLk+6, . . . , GLn display an image, and the first pixels PXa connected to the first scan lines GLk+1, GLk+3, GLk+5, . . . , GLn+1 do not display an image.

Since the first pixels PXa display an image only in the first frame Fs, and the second pixels PXb display an image only in the second frame Fs+1, the second driving frequency of the second display area DA2 may be ½ of the first driving frequency of the first display area DA1.

As shown in FIG. 12, in the second display area DA2, since the first pixels PXa and the second pixels PXb are alternately disposed in the first direction DR1 and the second direction DR2, even if the second driving frequency of the second display area DA2 is lower than the first driving frequency, it is possible to prevent a user from recognizing flicker.

In relation to a display device having such a configuration, when a moving image is displayed in the first display area and a still image is displayed in the second display area, power consumption can be reduced by lowering the driving frequency of the second display area than that of the first display area. In particular, the second scan driving circuit driving the second display area may minimize deterioration of display quality by alternately driving the first scan lines and the second scan lines.

Although the exemplary embodiments of the inventive concept have been described, it is understood that the inventive concept should not be limited to these exemplary embodiments but various changes and modifications can be made by one ordinary skilled in the art within the spirit and scope of the inventive concept as hereinafter claimed.

What is claimed is:

1. A display device comprising:

a display panel which defines a first display area and a second display area, and includes a plurality of pixels each connected to corresponding one of a plurality of data lines and corresponding several scan lines of a plurality of scan lines;

a data driving circuit which drives the plurality of data lines;

a scan driving circuit which drives the plurality of scan lines in response to first to fourth clock signals; and a driving controller which receives an image signal and a control signal, controls the data driving circuit and the scan driving circuit according to an operation mode, and outputs the first to fourth clock signals having different phases, wherein the scan driving circuit comprises a first scan driving circuit corresponding to the first display area and a second scan driving circuit corresponding to the second display area, wherein a first frame of a multi-frequency mode comprises a first driving period and a second driving period consecutive with the first driving period, wherein a second frame consecutive with the first frame in the multi-frequency mode comprises a third driving period and a fourth driving period consecutive with the third driving period, wherein, in the multi-frequency mode, the first scan driving circuit sequentially drives scan lines corresponding to the first display area among the plurality of scan lines during each of the first driving period and the third driving period, and wherein, in the multi-frequency mode, the second scan driving circuit sequentially drives first scan lines corresponding to the second display area among the plurality of scan lines during the second driving period, and sequentially drives second scan lines corresponding to the second display area among the plurality of scan lines during the fourth driving period, wherein the driving controller outputs the second and fourth clock signals of an inactive level during the second driving period, and outputs the first and third clock signals of an inactive level during the fourth driving period.

2. The display device of claim 1, wherein the first scan lines and the second scan lines extend in a first direction and are alternately arranged in a second direction intersecting the first direction.

3. The display device of claim 2, wherein the second scan driving circuit sequentially drives the first scan lines and the second scan lines in an order of being arranged in the second direction during a normal frequency mode.

4. The display device of claim 1, wherein the second scan driving circuit comprises:

a plurality of first driving stages each which outputs a first scan signal to a corresponding first scan line among the first scan lines in response to the first and third clock signals and a first carry signal; and a plurality of second driving stages each which outputs a second scan signal to a corresponding second scan line among the second scan lines in response to the second and fourth clock signals and a second carry signal.

5. The display device of claim 4, wherein the first scan signal outputted from a j-th first driving stage among the plurality of first driving stages is provided as the first carry signal of a (j+1)-th first driving stage among the plurality of first driving stages, wherein the second scan signal outputted from a j-th second driving stage among the plurality of second driving stages is provided as the second carry signal of a (j+1)-th second driving stage among the plurality of second driving stages, wherein j is a natural number.

6. The display device of claim 4, wherein one of the plurality of first driving stages receive a scan signal outputted from the first scan driving circuit as the first carry signal and one of the plurality of second driving stages receive a scan signal outputted from the first scan driving circuit as the second carry signal.

7. The display device of claim 1, wherein the first scan driving circuit comprises a plurality of driving stages each which outputs a scan signal to a scan line corresponding to the first display area among the plurality of scan lines in response to corresponding clock signals among the first to fourth clock signals and a carry signal.

8. The display device of claim 7, wherein the driving controller provides a start signal to the first scan driving circuit, wherein a first driving stage of the plurality of driving stages of the first scan driving circuit receives the start signal as the carry signal.

9. The display device of claim 1, wherein the second scan driving circuit comprises a plurality of driving stages each which outputs a scan signal to a corresponding scan line of the first and second scan lines in response to corresponding clock signals among the first to fourth clock signals and a carry signal.

10. The display device of claim 9, wherein one of the plurality of driving stages of the second scan driving circuit receives a scan signal outputted from the first scan driving circuit as the carry signal.

11. The display device of claim 9, wherein the scan signal outputted from a j-th driving stage among the plurality of driving stages of the second scan driving circuit is provided as the carry signal of a (j+1)-th driving stage, wherein j is a natural number.

12. The display device of claim 1, wherein the second display area of the display panel comprises:

a plurality of first pixels each connected to corresponding one of the first scan lines; and a plurality of second pixels each connected to corresponding one of the second scan lines.

13. The display device of claim 12, wherein the plurality of first pixels and the plurality of second pixels are alternately arranged in a first direction, wherein the plurality of first pixels and the plurality of second pixels are alternately arranged in a second direction intersecting the first direction.

14. The display device of claim 13, wherein the first scan lines and the second scan lines are alternately arranged in the second direction.

15. A display device comprising:

a display panel which includes a plurality of pixels each connected to corresponding one of a plurality of data lines and corresponding several scan lines of a plurality of scan lines, respectively;

a data driving circuit which drives the plurality of data lines;

a scan driving circuit which drives the plurality of scan lines; and a driving controller which receives an image signal and a control signal, controls the data driving circuit and the scan driving circuit according to an operation mode, and outputs a plurality of clock signals;

wherein the display panel is divided into a first display area and a second display area, wherein the scan driving circuit comprises a first scan driving circuit corresponding to the first display area and a second scan driving circuit corresponding to the second display area, wherein a first frame of a multi-frequency mode comprises a first driving period and a second driving period consecutive with the first period, wherein a second frame consecutive with the first frame in the multi-frequency mode comprises a third driving period and a fourth driving period consecutive with the third period, wherein, in the multi-frequency mode, the first scan driving circuit sequentially drives scan lines corresponding to the first display area among the plurality of scan lines during each of the first driving period and the third driving period, and wherein, in the multi-frequency mode, the second scan driving circuit sequentially drives only first scan lines corresponding to the second display area among the plurality of scan lines during the second driving period, and sequentially drives only second scan lines corresponding to the second display area among the plurality of scan lines during the fourth driving period, and wherein a second line of the second scan lines is disposed between each pair of contiguous first scan lines.

16. The display device of claim 15, wherein the first scan lines and the second scan lines extend in a first direction and are alternately arranged in a second direction intersecting the first direction.

17. The display device of claim 15, wherein the plurality of clock signals includes first to fourth clock signals, wherein the driving controller outputs the first to fourth clock signals having different phases, outputs the second and fourth clock signals of an inactive level during the second driving period, and outputs the first and third clock signals of an inactive level during the fourth driving period.

18. The display device of claim 17, wherein the second scan driving circuit comprises:

a plurality of first driving stages each which outputs a first scan signal to a corresponding first scan line among the first scan lines in response to the first and third clock signals and a first carry signal; and a plurality of second driving stages each which outputs a second scan signal to a corresponding second scan line among the second scan lines in response to the second and fourth clock signals and a second carry signal.

19. The display device of claim 15, wherein the second display area of the display panel comprises:

a plurality of first pixels each connected to corresponding one of the first scan lines; and a plurality of second pixels each connected to corresponding one of the second scan lines, wherein the plurality of first pixels and the plurality of second pixels are alternately arranged in a first direction, wherein the plurality of first pixels and the plurality of second pixels are alternately arranged in a second direction intersecting the first direction.

* * * * *